US005636973A

United States Patent [19]

Sonobe et al.

[11] Patent Number: 5,636,973

[45] Date of Patent: Jun. 10, 1997

[54] CRANK CHAMBER PRESSURE CONTROLLED SWASH PLATE COMPRESSOR WITH SUCTION PASSAGE OPENING DELAY DURING INITIAL LOAD CONDITION

[75] Inventors: Masanori Sonobe; Masahiro Kawaguchi; Ken Suitou; Shinichi Ogura, all of Kariya, Japan

[73] Assignee: Kabushiki Kaisha Toyoda Jidoshokki Seisakusho, Kariya, Japan

[21] Appl. No.: 568,158

[22] Filed: Dec. 6, 1995

[30] Foreign Application Priority Data

Dec. 7, 1994 [JP] Japan ..... 6-303940

[51] Int. Cl.[6] ..... F04B 1/29

[52] U.S. Cl. ..... 417/222.2; 417/298

[58] Field of Search ..... 417/222.1, 222.2, 417/270, 298

[56] References Cited

U.S. PATENT DOCUMENTS

| | | | |
|---|---|---|---|
| 5,173,032 | 12/1992 | Taguchi et al. . | |
| 5,529,461 | 6/1996 | Kawaguchi et al. | 417/222.2 |
| 5,547,346 | 8/1996 | Kanzaki et al. | 417/222.2 |
| 5,577,894 | 11/1996 | Kawaguchi et al. | 417/222.2 |

FOREIGN PATENT DOCUMENTS

| | | | |
|---|---|---|---|
| 0340024 | 11/1989 | European Pat. Off. . | |
| 0628722 | 12/1994 | European Pat. Off. . | |
| 4439512 | 5/1995 | Germany . | |
| 4446832 | 6/1995 | Germany | 417/222.2 |

*Primary Examiner*—Timothy Thorpe
*Assistant Examiner*—Roland G. McAndrews, Jr.
*Attorney, Agent, or Firm*—Brooks Haidt Haffner & Delahunty

[57] ABSTRACT

A compressor has a swash plate tiltable between maximum and minimum inclining angles with respect to a plane perpendicular to an axis of a drive shaft according to a difference between pressures in a crank chamber and a suction chamber. An internal gas passage includes the crank chamber, the suction chamber and a discharge chamber. The internal gas passage is connected to an external circuit separately provided from the compressor. The rotation of the drive shaft is converted to a reciprocating movement of a piston to vary a capacity of a cylinder bore. The piston compresses a gas supplied from the external circuit to the internal gas passage and discharges the gas to the external circuit. A inhibiting apparatus inhibits the circulation of the gas through the internal gas passage and the external circuit when the swash plate is located between the minimum inclining angle and a first inclining angle. The first inclining angle is greater than the minimum inclining angle of the swash plate.

27 Claims, 14 Drawing Sheets

CRANK CHAMBER PRESSURE CONTROLLED SWASH PLATE COMPRESSOR WITH SUCTION PASSAGE OPENING DELAY DURING INITIAL LOAD CONDITION

BACKGROUND OF THE INVENTION

1. Field of the Invention

The present invention relates to a piston type variable displacement compressor. More specifically, this invention relates to a piston type variable displacement compressor which adjusts the pressure in a crank chamber to control the inclined angle of a swash plate based on the difference between the pressure in the crank chamber and the suction pressure.

2. Description of the Related Art

In general, compressors are mounted in vehicles to supply compressed refrigerant gas to the vehicle's air conditioning system. To maintain the air temperature inside the vehicle at a level comfortable for the vehicle's passengers, it is important to use a compressor whose displacement is controllable. One known compressor of this type controls the inclined angle of a swash plate, tiltably supported on a drive shaft, based on the difference between the pressure in a crank chamber and the suction pressure, and converts the rotational motion of the swash plate to reciprocal linear motion of each piston.

A conventional piston type compressor disclosed in U.S. Pat. No. 5,173,032 uses no electromagnetic clutch for the transmission and blocking of power between an external driving source and the drive shaft of the compressor. The external driving source is coupled directly to the drive shaft.

The clutchless structure with the driving source coupled directly to the drive shaft can eliminate shocks which would otherwise be produced by the ON/OFF action of such a clutch. When such a compressor is mounted in a vehicle, passenger comfort is improved. The clutchless structure can also reduce the overall weight of the cooling system and thus reduce costs.

In such a clutchless system, the compressor runs even when no cooling is needed. With such compressors, it is important that when cooling is unnecessary, the discharge displacement be reduced as much as possible to prevent the evaporator from frosting. When no cooling is needed or there is a probability of frosting, the circulation of the refrigerant gas through the compressor and its external refrigeration circuit should be stopped. The compressor described in the aforementioned U.S. patent is designed to block the flow of gas into the suction chamber from the external refrigeration circuit by the use of an electromagnetic valve to stop the circulation of the refrigerant gas.

In the compressor described above, when the flow of the gas from the external refrigeration circuit into the suction chamber is blocked, the pressure in the suction chamber drops drastically and the control valve responsive to that pressure opens fully. The full opening of the control valve allows the gas in the discharge chamber to flow into the crank chamber, which in turn raises the pressure in the crank chamber. When the pressure in the suction chamber falls, the suction pressure in the cylinder bores falls, too, thus increasing the difference between the pressure in the crank chamber and the pressure in the cylinder bores. This pressure differential in turn minimizes the inclination of the swash plate which reciprocates the pistons. As a result, the discharge displacement is minimized. At this time, the driving torque needed by the compressor is minimized, thus reducing power loss as much as possible.

The crank chamber is communicated with the suction chamber by a through hole. When the flow of gas from the external refrigeration circuit to the suction chamber is blocked, the gas that is discharged into the discharge chamber from the cylinder bores is drawn into the crank chamber by way of the opened control valve. The gas in the crank chamber flows into the suction chamber by way of the through holes. The gas is then drawn into the cylinder bores during the suction stroke of the piston. In other words, when the flow of gas from the external circuit is blocked, the cylinder bores, discharge chamber, crank chamber, suction chamber, and cylinder bores establish a gas circulation path in the compressor. A lubricating oil is suspended in the gas. The lubricating oil is conveyed in the circulation path together with the gas during circulation of the gas. The lubricating oil lubricates the parts inside the compressor.

When the gas flow to the suction chamber from the external refrigeration circuit is commenced, the pressure in the suction chamber rises, and then the control valve closes. This inhibits the gas flow into the crank chamber from the discharge chamber, lowering the pressure in the crank chamber. As the pressure in the suction chamber rises, the suction pressure in the cylinder bores rises too. The difference between the pressure in the crank chamber and the pressure in the cylinder bores therefore becomes smaller, and the inclined angle of the swash plate is increased to it's maximum, maximizing the discharge displacement.

To reduce power loss, the inclined angle of the swash plate should be minimized as much as possible when the flow of gas into the suction chamber is inhibited, or when the discharge displacement is minimized. However, the minimum swash plate angle must be determined while considering lubrication of the compressor.

The gas discharged into the external circuit by the compressor returns to the compressor after performing heat exchange with a condenser and an evaporator provided in the external circuit. Lubricating oil in the compressor is conveyed to the external circuit suspended in the gas and returns to the compressor together with the gas. However, the gas flowing in the external circuit must be more than a predetermined amount to return the lubricating oil to the compressor together with the gas. The flow amount of the gas depends on the inclined angle of the swash plate. Therefore, when the inclination of the swash plate is too small, the gas flow is smaller than the predetermined amount. This results in only the gas returning to the compressor from the external circuit. Hence, when the gas in the compressor is discharged, with the lubricating oil suspended therein, into the external circuit and returned to the compressor without the lubricating oil, lubrication within the compressor will be insufficient.

When the flow of gas from the external circuit to the suction chamber is blocked, lubricating oil does not flow from the inside to the outside of the compressor since the gas inside the compressor circulates in the circulation path while the gas outside the compressor remains outside. However, when flow of gas from the external circuit to the suction chamber is commenced, the compressor will be inadequately lubricated since the flow of gas is below an amount required to return the lubricating oil into the compressor from the external circuit. Therefore, with the compressor disclosed in the above U.S. patent, it is necessary that the gas flow rate in the external circuit be more than that required to return the lubricating oil into the compressor when inclination of the swash plate is slightly larger than its minimum inclined angle. In other words, the minimum inclined angle of the swash plate must be larger than that enabling a sufficient flow of gas to return the lubricating oil from the outside of the compressor to its inside.

SUMMARY OF THE INVENTION

Accordingly, it is a primary objective of the present invention to provide a compressor which can ensure smooth lubrication and enable reduction in power loss.

To achieve the above objects, the compressor according to the present invention has a swash plate tiltable between maximum and minimum inclining angles with respect to a plane prependicular to an axis of a drive shaft according to a difference between pressures in a crank chamber and a suction chamber. An internal gas passage includes the crank chamber, the suction chamber and a discharge chamber. The internal gas passage is connected to an external circuit separately provided from the compressor. The rotation of the drive shaft is converted to a reciprocating movement of a piston to vary a capacity of a cylinder bore. The piston compresses a gas supplied from the external circuit to the internal gas passage and discharges the gas to the external circuit. A inhibiting apparatus inhibits the circulation of the gas through the internal gas passage and the external circuit when the swash plate is located between the minimum inclining angle and a first inclining angle. The first inclining angle is greater than the minimum inclining angle of the swash plate.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A compressor according to a first embodiment of the present invention will now be described with reference to FIGS. 1 through 8.

Figure 1:
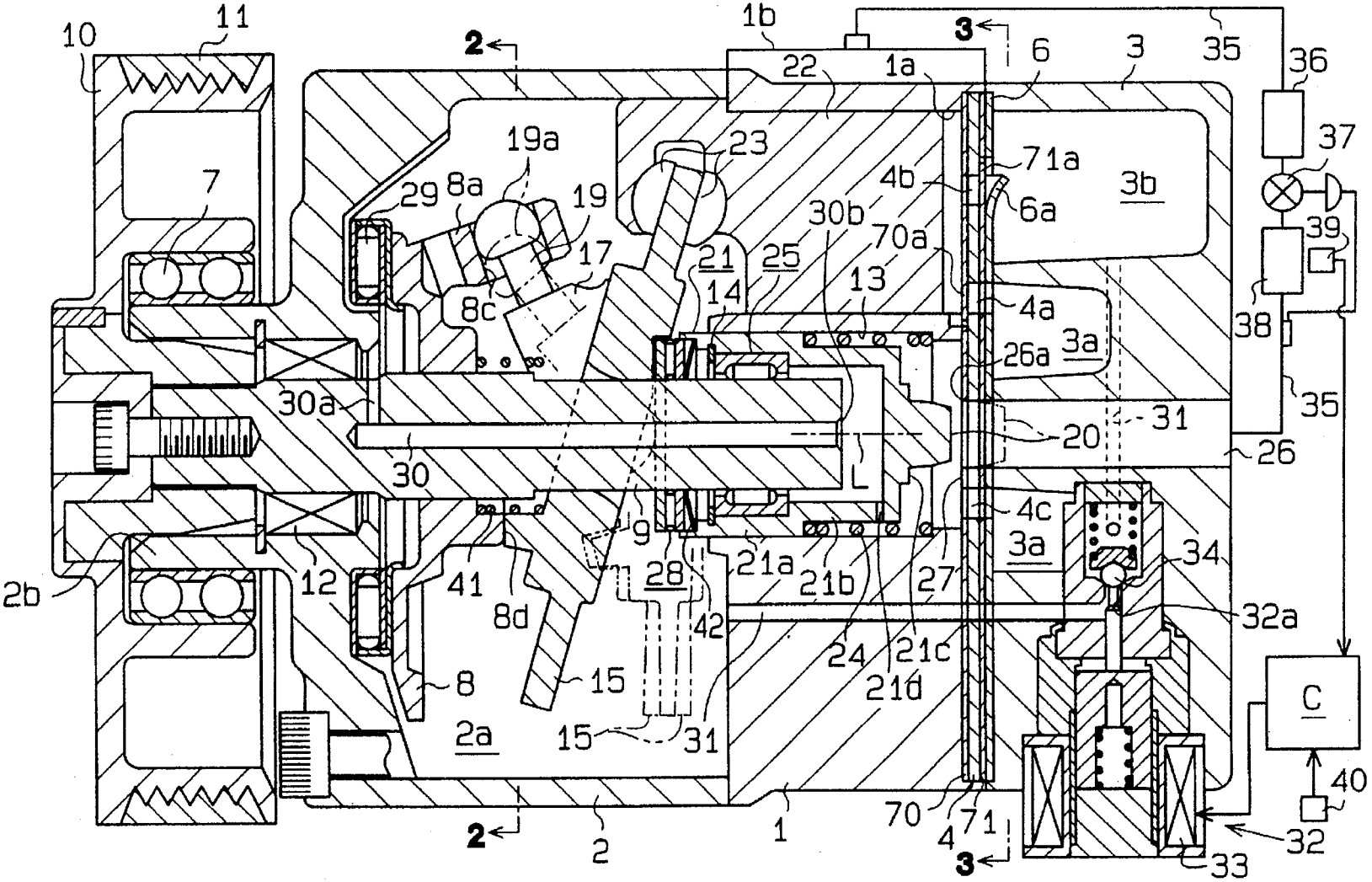
FIG. 1 is a side elevational cross-section view of an overall compressor according to a first embodiment of the present invention.

As shown in FIG. 1, a cylinder block 1 constitutes a part of the housing of the compressor. A front housing 2 is secured to the front end of the cylinder block 1. A rear housing 3 is secured to the rear end of the cylinder block 1 with a first plate 4, a second plate 70, a third plate 71 and a fourth plate 6. A crank chamber 2*a* is defined in the front housing 2. A drive shaft 9 is supported rotatably on the front housing 2 and the cylinder block 1. The front end of the drive shaft 9 protrudes outside the crank chamber 2*a*, with a pulley 10 secured to this front end. The pulley 10 is coupled to an engine of a vehicle via a belt 11.

A support pipe 2*b* protrudes from the front end of the front housing 2 in such a way as to surround the front end of the drive shaft 9. The pulley 10 is supported via an angular bearing 7 on the support pipe 2*b*. Through the angular bearing 7, the support pipe 2*b* receives both the axial load and radial load which act on the pulley 10. A lip seal 12 is disposed between the front end of the drive shaft 9 and the front housing 2. The lip seal 12 prevents pressure leakage from the crank chamber 2*a*.

Figure 2:
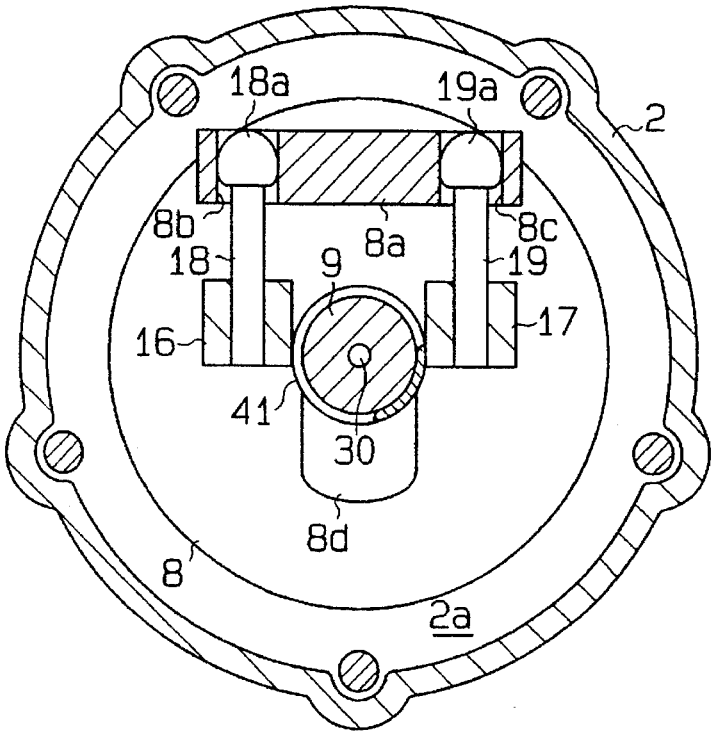
FIG. 2 is a cross-sectional view taken along the line 2—2 in FIG. 1.

A swash plate 15 is supported by the drive shaft 9 in such a way as to be slidable along and tiltable with respect to the axis L of the shaft 9. As shown in FIGS. 1 and 2, a pair of stays 16 and 17 are secured to the swash plate 15, with guide pins 18 and 19 fixed to the respective stays 16 and 17. Guide balls 18*a* and 19*a* are formed at the distal ends of the respective guide pins 18 and 19. A drive plate 8 is fixed to the drive shaft 9. The drive plate 8 has a support arm 8*a* protruding toward the swash plate 15 (rearward) from the drive plate 8. A pair of guide holes 8*b* and 8*c* are formed in the arm 8*a*, and the guide balls 18*a* and 19*a* are slidably fitted in the associated guide holes 8*b* and 8*c*.

The cooperation of the arm 8*a* and the guide pins 18 and 19 permits the swash plate 15 to rotate together with the drive shaft 9 and to tilt with respect to the drive shaft 9. The tilting of the swash plate 15 is guided when the guide balls 18*a*, 19*a* slide in the associated guide holes 8*b*, 8*c* and the swash plate 15 slides along the axis L of the drive shaft 9. The more the center portion of the swash plate 15 (the portion where the drive shaft is inserted) moves toward the cylinder block 1 side (rearward) along the axis L of the drive shaft 9, the smaller the inclination of the swash plate 15 becomes. A first spring 41 is located between the drive plate 8 and the swash plate 15. The first spring 41 urges the swash plate 15 toward its minimum angle position.

As shown in FIG. 1 and FIGS. 4 through 6, a shutter chamber 13 is formed in the center portion of the cylinder block 1, extending along the axis L of the drive shaft 9. A cylindrical spool 21 having one closed end is accommodated in the shutter chamber 13 in such a way as to be slidable along the axis L of the drive shaft 9. The spool 21 has a large diameter portion 21*a* and a small diameter portion 21*b*. A second spring 24 is located between the step portion between the large diameter portion 21*a* and small diameter portion 21*b* and the step portion of the inner wall of the shutter chamber 13. The second spring 24 urges the spool 21 toward the swash plate 15.

The rear end of the drive shaft 9 is inserted in the spool 21. A radial bearing 25 is located between the rear end of the drive shaft 9 and the inner wall of the large diameter portion 21*a* of the spool 21. The radial bearing 25 has rollers 25*a* and an outer race 25*b*. The outer race 25*b* is fixed to the inner wall of the large diameter portion 21*a*. The rollers 25*a* are slidable along the axis L of the drive shaft 9. A snap ring 14, attached to the inner walls of the large diameter portion 21*a*, inhibits separation of the radial bearing 25 from the spool 21. The rear end of the drive shaft 9 is supported by the inner wall of the shutter chamber 13 through the radial bearing 25 and the spool 21.

Figure 3:
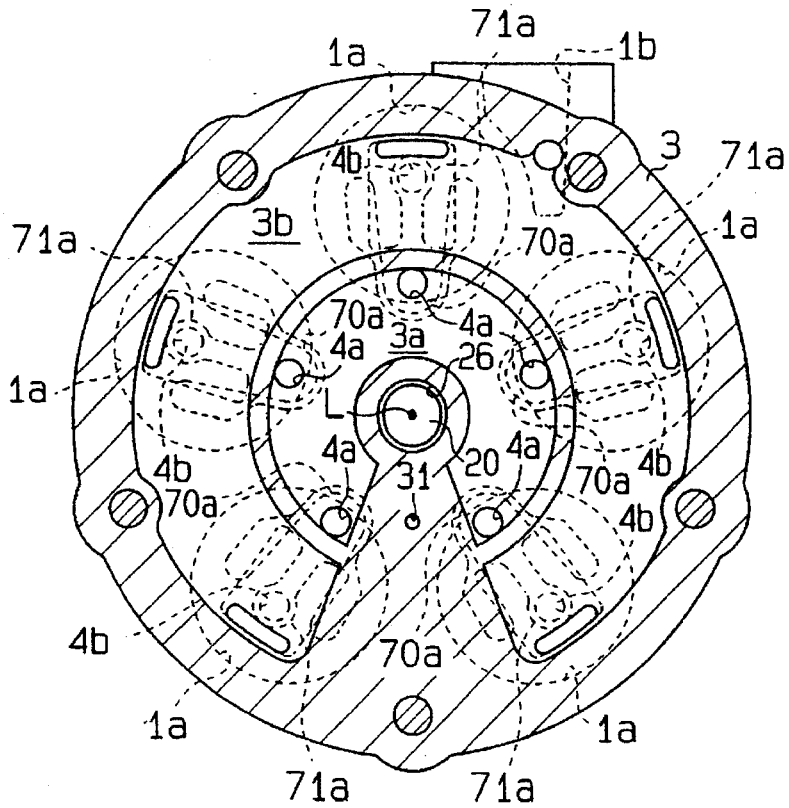
FIG. 3 is a cross-sectional view taken along the line 3—3 in FIG. 1.

A suction passage 26 is formed in the center portion of the rear housing 3, extending along the axis L of the drive shaft 9. As shown in FIG. 3, the suction passage 26 has a circular cross-section with its center coinciding with the axis L of the drive shaft 9. In other words, the suction passage 26 is defined along the axis of the drive shaft 9. The suction passage 26 communicates with the shutter chamber 13. A positioning surface 27 is formed on the second plate 70 between the shutter chamber 13 and the suction passage 26. The rear of the spool 21 constitutes a shutter surface 21*c* which is adapted to abut against the positioning surface 27. As the shutter surface 21*c* abuts against the positioning surface 27, the movement of the spool 21 in a direction away from the swash plate 15, or in the rearward direction, is restricted and the suction passage 26 is disconnected from the shutter chamber 13.

Figure 4:
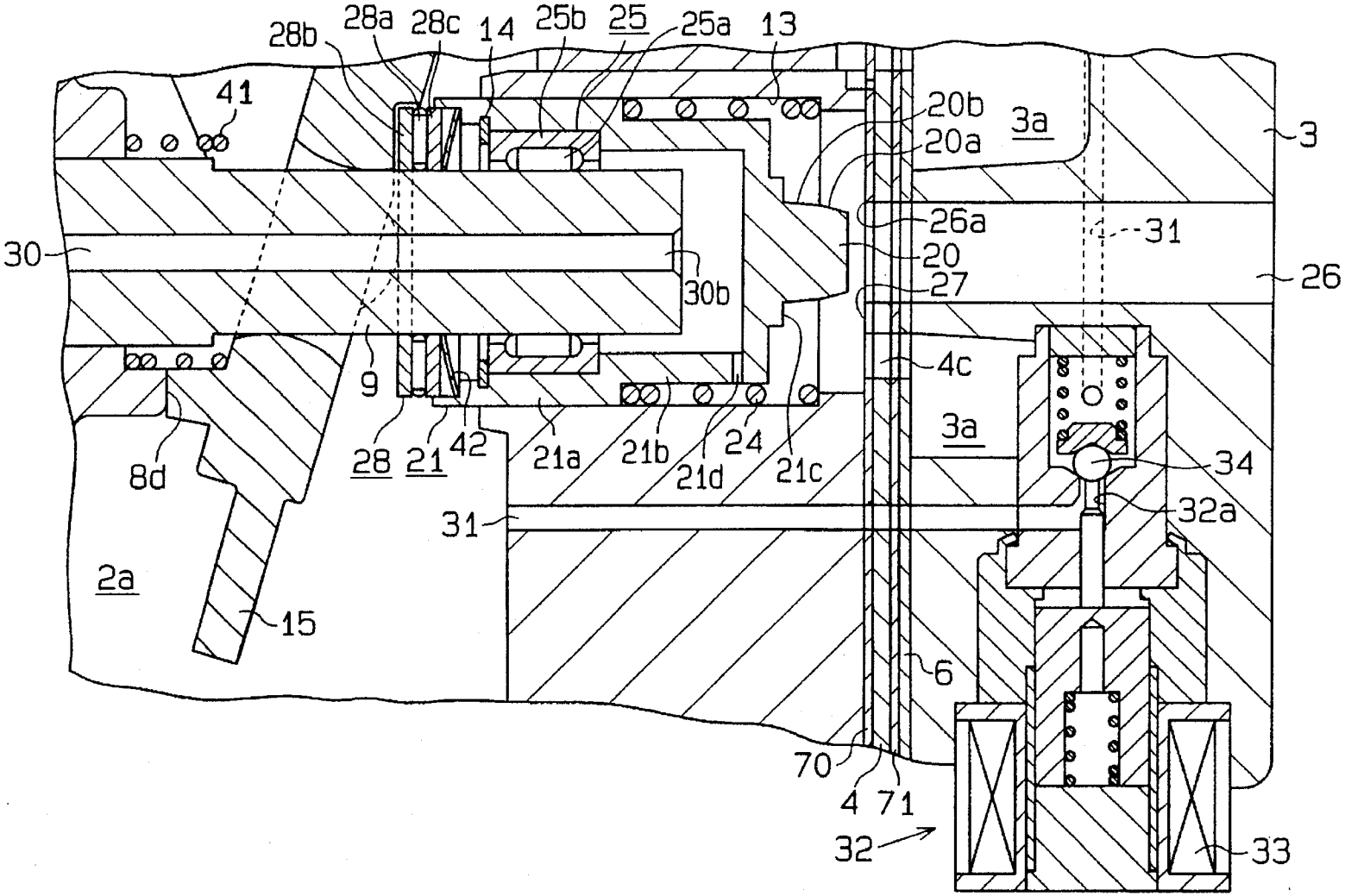
FIG. 4 is an enlarged cross-sectional view of essential parts partially showing the compressor when the swash plate is at a maximum inclined angle.

A restriction 20 is formed integrally with the shutter surface 21*c* of the spool 21. As shown in FIG. 4, a surface of the restriction 20 has a tapered first surface 20*a* at a distal end and a tapered second surface 20*b* at a proximal end. As shown in FIG. 3, the restriction 20 has a circular cross-section with its center coinciding with the axis L of the drive shaft 9. The taper of the second surface 20*b* is more gradual than that of the first surface 20*a* with respect to the axis L. The restriction 20 may be advanced into the suction passage 26. The outer diameter of the proximal end of the restriction 20 is slightly smaller than the inner diameter of the suction passage 26. This results in a space defined between the outer surface of the restriction 20 and the inner wall of the suction passage 26.

As shown in FIG. 4, a thrust bearing 28 is slidably attached to the drive shaft 9 between the swash plate 15 and the spool 21. The thrust bearing 28 has rollers 28*a* and a pair of races 28*b*, 28*c* on opposite sides of the rollers 28*a*. A belleville spring 42 is disposed between the race 28*c* and the end face of the large diameter portion 21*a* of the spool 21. The thrust bearing 28 is constantly clamped between the swash plate 15 and the end face of the large diameter portion 21*a* of the spool 21 by the urging force of the second spring 24.

As the swash plate 15 moves toward the spool 21, it pushes the race 28*b* of the thrust bearing 28. As a result, the spool 21 moves toward the positioning surface 27 against the urging force of the second spring 24 through the thrust bearing 28 and the belleville spring 42. The spring force of the belleville spring 42 is greater than that of the second spring 24. The thrust bearing 28 prevents the rotation of the swash plate 15 from being transmitted to the spool 21. The rotation of the spool 21 would increase the load torque of the compressor. The torque would increase especially when the spool 21 rotates during abutment of the shutter surface 21*c* of the spool 21 with the positioning surface 27. The thrust bearing 28 prevents such increase of load torque.

As shown in FIGS. 1 and 3, a plurality of cylinder bores 1*a* are formed in the cylinder block 1 in such a way as to communicate with the crank chamber 2*a*. Single-headed pistons 22 are retained in the associated cylinder bores 1*a*. The hemispherical portions of a pair of shoes 23 are fitted on each piston 22 in a mutually slidable manner. The swash plate 15 is held between the flat portions of both shoes 23. Accordingly, the undulation of the swash plate 15 caused by the rotation of the drive shaft 9 is transmitted through the shoes 23 to each piston 22, so that each piston 22 reciprocates in the associated cylinder bore la in accordance with the inclination of the swash plate 15.

A suction chamber 3*a* and a discharge chamber 3*b* are defined in the rear housing 3. Suction ports 4*a* and discharge ports 4*b* are formed in the first plate 4. Suction valves 70*a* are formed on the second plate 70, and discharge valves 71*a* are formed on the third plate 71. As each piston 22 moves backward, or away from the suction chamber 3*a*, the refrigerant gas in the suction chamber 3*a* forces the associated suction valve 70*a* to open and flows into the associated cylinder bore 1*a* through the associated suction port 4*a*. As each piston 22 moves forward, or toward the discharge chamber 3*b*, the refrigerant gas in the cylinder bores 1*a* forces the associated discharge valve 71*a* to open and flows into the discharge chamber 3*b* through the associated discharge port 4*b*. As each discharge valve 71*a* abuts against a retainer 6*a* formed on the fourth plate 6, the degree of opening of the associated discharge valve 71*a* is restricted.

A thrust bearing 29 is placed between the drive plate 8 and the front housing 2. The thrust bearing 29 receives the compressive reaction force, generated in the cylinder bores 1*a*, that acts on the drive plate 8 via the pistons 22, the shoes 23, the swash plate 15, the stays 16 and 17 and the guide pins 18, 19.

The suction chamber 3*a* communicates with the shutter chamber 13 via a communication hole 4*c*. The communication hole 4*c* is blocked from the suction passage 26 when the shutter surface 21*c* of the spool 21 abuts against the positioning surface 27.

A passage 30 is formed in the drive shaft 9. The passage 30 has an inlet 30*a* open to the crank chamber 2*a* in the vicinity of the lip seal 12, and an outlet 30*b* open to the interior of the spool 21. As shown in FIG. 1 and FIGS. 4 through 6, a pressure release hole 21*d* is formed in the surface of the small diameter portion 21*b* of the spool 21. The hole 21*d* communicates the interior of the spool 21 with the shutter chamber 13.

As shown in FIGS. 1 and 4, a supply passage 31 connects the discharge chamber 3*b* to the crank chamber 2*a*. An electromagnetic valve 32 is attached to the rear housing 3 and is located midway in the supply passage 31. When the solenoid 33 of the electromagnetic valve 32 is excited, a valve body 34 closes a valve hole 32*a*. When the solenoid 33 is de-excited, the valve body 34 opens the valve hole 32*a*. Therefore, the electromagnetic valve 32 selectively opens or closes the supply passage 31 between the discharge chamber 3*b* and the crank chamber 2*a*.

An external refrigeration circuit 35 connects the suction passage 26 for supplying the refrigerant gas into the suction chamber 3*a* to the outlet port 1*b* for discharging the refrigerant gas from the discharge chamber 3*b*. Provided above the external refrigeration circuit 35 are a condenser 36, an expansion valve 37, and an evaporator 38. The expansion valve 37, which is a thermal automatic expansion valve, controls the flow rate of the refrigerant in accordance with a change in gas temperature on the outlet side of the evaporator 38. A temperature sensor 39 is located near the evaporator 38. The temperature sensor 39 detects the temperature in the evaporator 38, and outputs a signal based on the detected temperature to a computer C.

The computer C controls the solenoid 33 of the electromagnetic valve 32 based on the signal from the temperature sensor 39. More specifically, when the temperature detected by the temperature sensor 39 is equal to or below a predetermined value while an activation switch 40 of the air conditioning system is set on, the computer C de-excites the solenoid 33 to prevent frosting from taking place in the evaporator 38. The computer C de-excites the solenoid 33 when the activation switch 40 is switched off.

FIGS. 1 and 4 show the solenoid 33 in an excited state in which the supply passage 31 is closed. Therefore, the refrigerant gas under high pressure in the discharge chamber 3*b* is not supplied to the crank chamber 2*a*. In this situation, the refrigerant gas in the crank chamber 2*a* simply flows out to the suction chamber 3*a* via the passage 30 and the pressure release hole 21*d* so that the pressure in the crank chamber 2*a* approaches the low pressure in the suction chamber 3*a*, i.e., the suction pressure. As a result, the pressure difference between the crank chamber 2*a* and the cylinder bores 1*a* is reduced and the inclined angle of the swash plate 15 becomes maximized. Abutting on a projection 8*d* of the drive plate 8, the swash plate 15 is restricted not to incline beyond a predetermined maximum inclined angle. As a result, the inclined angle of the swash plate 15 is held at the maximum and the discharge displacement of the compressor is maximized. Since the refrigerant gas in the crank chamber 2*a* passes through the inlet 30*a* provided near the lip seal 12, the lubricating oil suspended in the refrigerant gas improves the lubrication and sealing between the lip seal 12 and the drive shaft 9.

When the gas is discharged with the swash plate 15 kept at the maximum inclined angle while the cooling load of the compressor becomes lower, the temperature in the evaporator 38 falls to approach the value that may cause frosting. When the temperature detected by the temperature sensor 39 becomes equal to or lower than the predetermined value, the computer C de-excites the solenoid 33. When the solenoid 33 is de-excited, the supply passage 31 is opened to connect the discharge chamber 3*b* to the crank chamber 2*a*. Consequently, the refrigerant gas under high pressure in the discharge chamber 3*b* flows into the crank chamber 2*a* via the supply passage 31, raising the pressure in the crank chamber 2*a*. The difference between the pressure in the crank chamber 2*a* and the pressure in the cylinder bores 1*a* therefore increases and the inclined angle of the swash plate 15 becomes smaller.

Furthermore, when the solenoid 33 is de-excited by turning the switch 40 off, the inclined angle of the swash plate 15 shifts toward the minimum inclined angle.

Since the spring force of the belleville spring 42 is larger than the second spring 24, the spool 21 moves toward the positioning surface 27 while pressing the second spring 24 and contracting it as the inclined angle of the swash plate 15 is reduced. As the spool 21 advances, the restriction 20 enters the suction passage 26. When the entire restriction 20 is in the suction passage 26, the shutter surface 21*c* abuts against the positioning surface 27 and completely blocks the suction passage 26.

Figure 7:
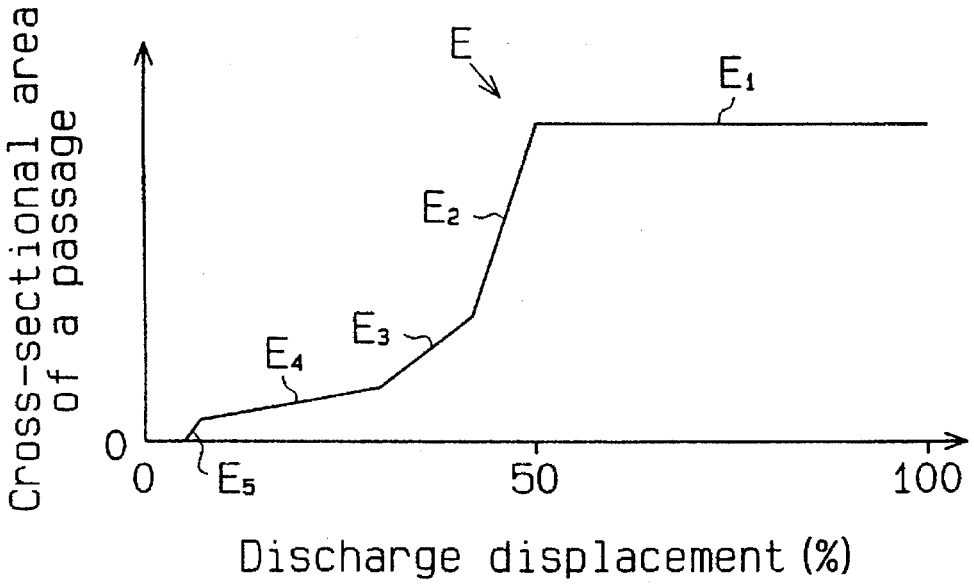
FIG. 7 is a graph showing the relationship between discharge displacement of the compressor and the transitional cross-sectional area of a passage enabling flow of refrigerant gas in a suction passage.

A curve E shown in the graph of FIG. 7 shows the relationship between the discharge displacement of the compressor and the transitional cross-sectional area of the suction passage 26 in which gas flows through. Lines $E_1$ and $E_2$ indicate the transitional cross-sectional area defined by the space between the periphery of the distal end of the restriction 20 and the periphery of the outlet of the suction passage 26 when the restriction 20 is positioned separated from the suction passage 26. Line $E_3$ indicates the transitional cross-sectional area when the first surface 20*a* of the restriction 20 starts advancing into the suction passage 26. Line $E_4$ indicates the transitional cross-sectional area when the second surface 20*b* starts advancing into the suction passage 26. Line $E_5$ indicates the transitional cross-sectional area defined by the shutter surface 21*c* of the spool 21 and a peripheral wall 26*a* of the suction passage 26.

The alteration ratio of the transitional cross-sectional area in the suction passage 26 becomes moderate when the discharge displacement is small due to the tapered first and second surfaces 20*a*, 20*b*. The restricting effect resulting from the moderate alteration ratio of the transitional cross-sectional area gradually reduces the flow of the refrigerant gas from the suction passage 26 to the suction chamber 26. Hence, the amount of refrigerant gas drawn into the cylinder bores 1*a* from the suction chamber 3*a* is gradually reduced. This, in turn, gradually reduces the discharge displacement. Accordingly, the discharge pressure decreases gradually and does not greatly alter the load torque of the compressor within a short period of time. Therefore, alteration in load torque of the compressor becomes moderate when the discharge displacement is lowered from its maximum capacity to its minimum capacity. This reduces the impact produced by alteration in load torque.

Figure 5:
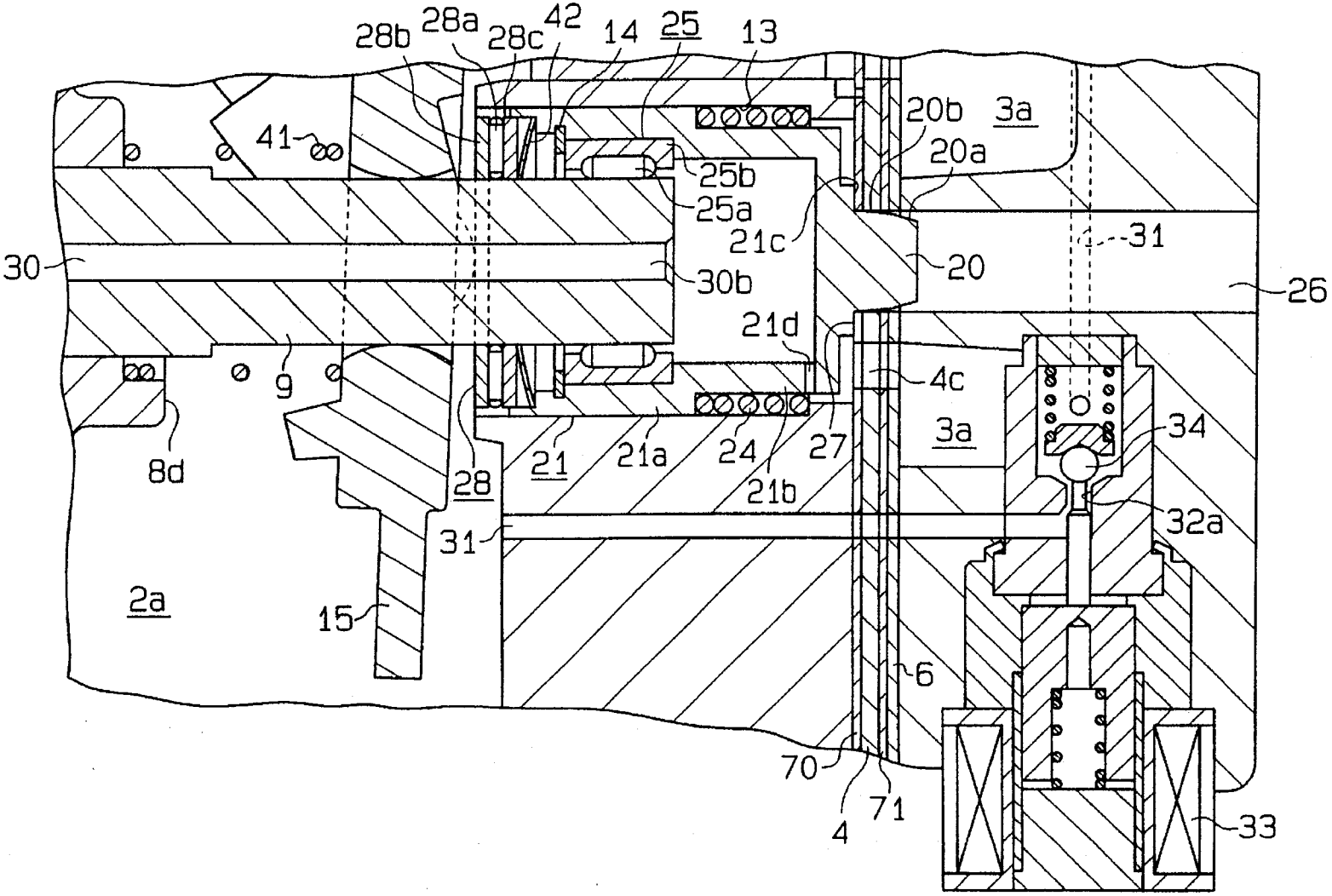
FIG. 5 is an enlarged cross-sectional view of essential parts partially showing the compressor when the swash plate is at an inclined angle which blocks the circulation of refrigerant gas.
Figure 6:
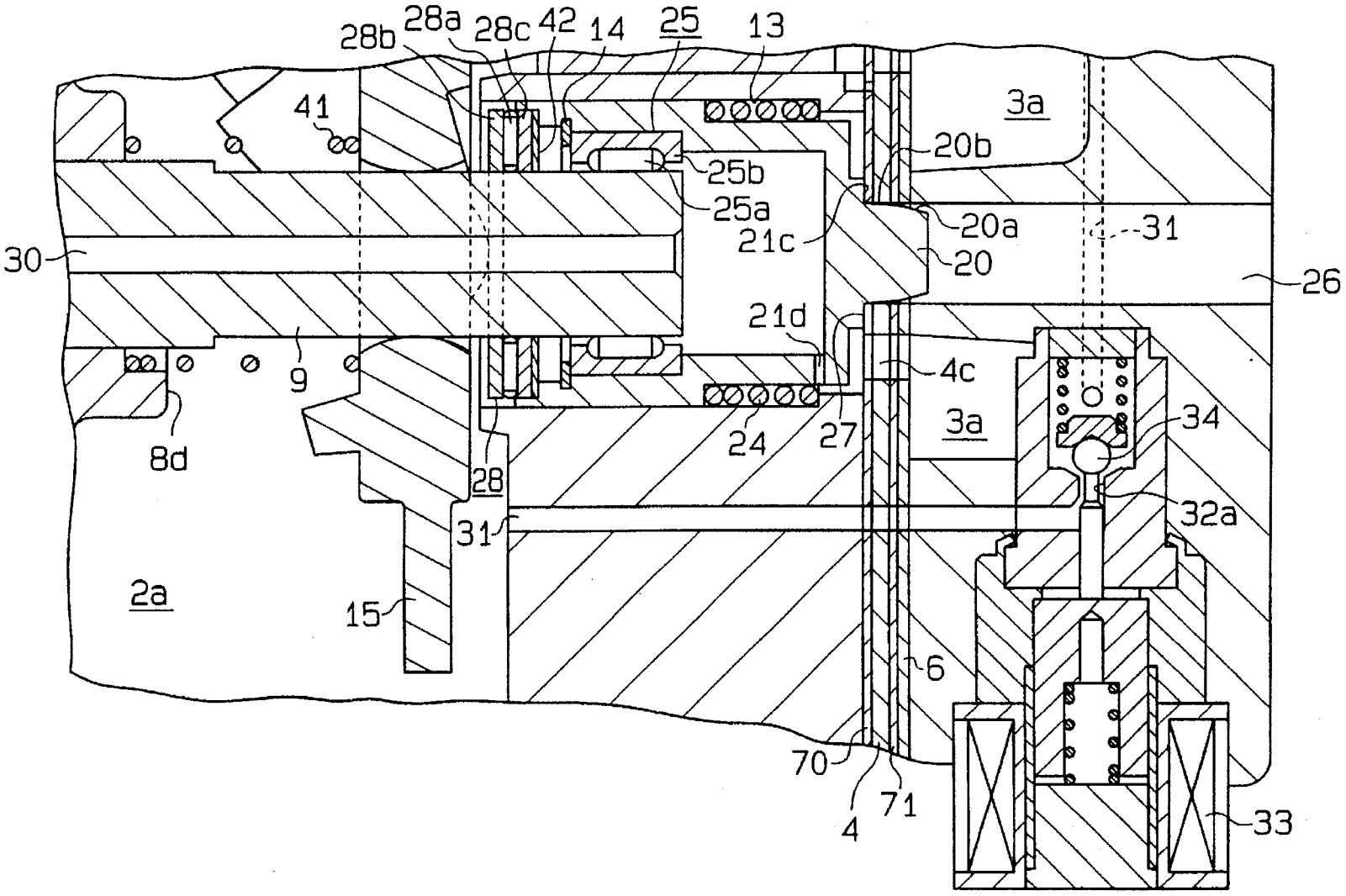
FIG. 6 is an enlarged cross-sectional view of essential parts partially showing the compressor when the swash plate is at a minimum inclined angle.

As shown in FIG. 5, the value of the transitional cross-sectional area becomes zero when the shutter surface 21*c* of the spool 21 abuts against the positioning surface 27. In this state, the refrigerant gas in the external refrigeration circuit 35 does not flow into the suction chamber 3*a*. That is, the inclined angle of the swash plate 15 as shown in FIG. 5 inhibits the circulation of refrigerant gas between the external refrigeration circuit 35 and the compressor. The belleville spring 42 may be deformed to a flatter shape than the state shown in FIG. 5. That is, the inclined angle of the swash plate 15 which blocks the circulation of the refrigerant gas as shown in FIG. 5 may further be reduced to a smaller angle as shown in FIG. 6. In this embodiment, the belleville spring 42 becomes flat as it is compressed between the race 28*c* of the thrust bearing 28 and the face end of the large diameter portion 21*a* of the spool 21. The race 28*c* of the thrust bearing 28, which prevents the rotation of the swash plate 15 from being transmitted to the spool 21, abuts against the entire inner rim of the belleville spring 42, thus allowing the spring 42 to be deformed into a flat state.

Figure 8:
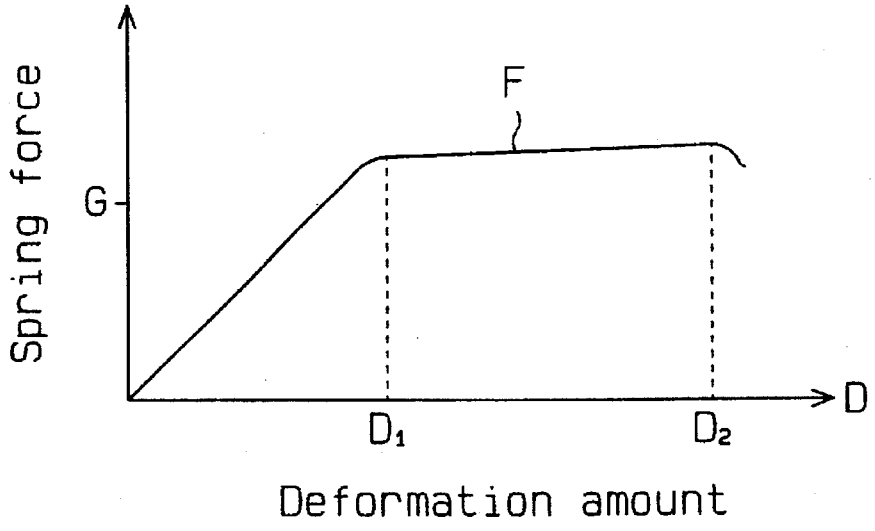
FIG. 8 is a graph showing the spring characteristics of a belleville spring.

Curve F shown in FIG. 8 indicates the spring characteristic of the belleville spring 42. In FIG. 8, the horizontal axis D represents deformation amount while the vertical axis represents spring force. The spring characteristic of the belleville spring is substantially constant at a certain deformation zone (in FIG. 8 between $D_1$ and $D_2$). Spring force G indicates the spring force of the second spring 24 when it is in the state as shown in FIG. 5, in which the spring 24 is most contracted. The spring force of the belleville spring 42 in the deformation zone (between $D_1$ and $D_2$) is set at a value larger than the value of the spring force G of the second spring. Such a relationship between the spring force of the second spring 24 and the spring force of the belleville spring 42 enables the minimum inclined angle of the swash plate 15 to be smaller than the inclined angle which blocks the circulation of refrigerant gas. In addition, the spring force of the first spring 41 and the pressure inside the crank chamber 2*a* (i.e., the force which urges the swash plate 15 to a direction reducing its inclination) is set at a value larger than the spring force of the belleville spring 42 in the deformation zone (between $D_1$ and $D_2$). Therefore, the swash plate 15 moves, as it deforms the belleville spring 42, from the inclined angle shown in FIG. 5, in which circulation of the refrigerant gas is blocked, to the minimum inclined angle shown in FIG. 6. When the belleville spring 42 becomes flat as shown in FIG. 6, the deformation amount of the spring is $D_2$.

The amount of inclination shift of the swash plate 15 is small when the plate 15 shifts from the inclined angle blocking the circulation of refrigerant gas to the minimum inclined angle, and thus the deformation amount $D_2$ of the belleville spring 42 is small. This enables the space necessary to accommodate the belleville spring 42, which corresponds to the small deformation amount $D_2$, to have a small dimension and thus only slightly effects the accommodating space necessary for the arrangement of other members. Therefore, the belleville spring 14 is an optimal means for enabling the swash plate 15 to move from the inclined angle blocking the circulation of refrigerant gas to the minimum inclined angle.

When the belleville spring 42 is flat, the inclined angle of the swash plate 15 is minimum. In other words, the minimum inclined angle of the swash plate 15 is restricted by the shutter surface 21*c* of the spool 21 abutting against the positioning surface 27 and the belleville spring 42 becoming flat. The positioning surface 27, spool 21, belleville spring 42 and thrust bearing 28 constitute a restricting means to restrict the minimum inclined angle of the swash plate 15.

The minimum inclined angle of the swash plate 15 is slightly larger than zero degrees. The minimum inclined angle is reached by further tilting the swash plate 15 to an angle where the belleville spring 42 becomes flat from a closing position in which the spool 21 shuts the communication between the suction passage 26 and the shutter chamber 13. The spool 21 moves cooperatively with the swash plate 15 from the opening position to a separated closing position.

Since the minimum inclined angle of the swash plate 15 is not zero degrees, the refrigerant gas is discharged into the discharge chamber 3*b* from the cylinder bores la even when the inclined angle of the swash plate 15 is minimized. Even when the inclined angle of the swash plate 15 is minimized, therefore, there a pressure difference exists between the discharge chamber 3*b*, the crank chamber 2*a* and the suction chamber 3*a*. The refrigerant gas discharged to the discharge chamber 3*b* from the cylinder bores la flows into the crank chamber 2*a* via the supply passage 31. The refrigerant gas in the crank chamber 2*a* flows into the suction chamber 3*a* via the passage 30 and the pressure release hole 21*d*, and the refrigerant gas in the suction chamber 3*a* is drawn into the cylinder bores 1*a* to be discharged to the discharge chamber 3*b*. With the inclined angle of the swash plate 15 at the minimum angle, therefore, a circulation path circulating the discharge chamber 3*b*, the supply passage 31, the crank chamber 2*a*, the passage 30, the pressure release hole 21*d*, the suction chamber 3*a*, and the cylinder bores 1*a* is formed in the compressor. The refrigerant gas circulates along this circulation path, and the lubricating oil suspended in the refrigerant gas lubricates the internal parts of the compressor.

When the cooling load of the compressor increases from the state shown in FIG. 6, the increase in cooling load appears as a rise in temperature in the evaporator 38. When the temperature detected by the temperature sensor 39 exceeds the predetermined value, the computer C excites the solenoid 33. When this excitation takes place, the supply passage 31 is closed to disconnect the discharge chamber 3*b* from the crank chamber 2*a*. Under this situation, the refrigerant gas in the crank chamber 2*a* flows out to the suction chamber 3*a* via the passage 30 and the pressure release hole 21*d*, and the pressure in the crank chamber 2*a* decreases. As a result, the inclined angle of the swash plate 15 shifts toward its maximum from its minimum.

As the inclined angle of the swash plate 15 is increased, the belleville spring 42 which had been in a flat state as shown in FIG. 6 returns to its original form as shown in FIG. 5. As the inclined angle of the swash plate 15 is further increased, the spool 21 is gradually separated from the positioning surface 27 by the spring force of the second spring 24. During this separation, the transitional cross-sectional area of the suction passage 26 is moderately increased. Thus, the amount of refrigerant gas which flows into the suction chamber 3*a* from the suction passage 26 gradually increases. This, in turn, gradually increases the amount of refrigerant gas drawn into the cylinder bores 1*a* and also gradually increases the discharge displacement of the compressor. Accordingly, the gradual increase in discharge pressure prevents the load torque of the compressor from being greatly altered in a short period of time. As a result, alteration in negative load torque of the compressor when the discharge displacement is increased from its minimum amount to its maximum amount becomes moderate, and the impact produced by the alteration becomes small.

The lubricating oil, suspended in the refrigerant gas, inside the compressor flows out to the external refrigeration circuit 35 and returns into the compressor together with the refrigerant gas. It is necessary to maintain the flow of refrigerant gas in the external refrigerant circuit 35 above a predetermined amount to return the lubricating oil from the circuit 35. Therefore, when the inclined angle of the swash plate 15 is smaller than an angle which obtains the required flow amount, only refrigerant gas returns to the compressor. Since the lubricating oil, suspended in the refrigerant gas, inside the compressor keeps flowing out to the external refrigeration circuit 35, the amount of lubricating oil inside the compressor decreases and will be inadequate unless the oil is returned to the compressor. When the flow of gas from the external refrigeration circuit 35 to the suction chamber 3*a* is blocked, refrigerant gas does not flow into the compressor and the refrigerant gas inside the compressor circulates therein. Hence, lubricating oil does not flow out of the compressor. However, if the flow amount of the refrigerant gas in the external refrigeration circuit 35 is not sufficient to return the lubricating oil to the compressor when the flow of gas from the external refrigeration circuit 35 to the suction chamber 3*a* is commenced, lubrication will be inadequate in the compressor.

In the present embodiment, circulation of the refrigerant gas is blocked when the angle of the swash plate 15 is between its minimum inclined angle as shown in FIG. 6 and a larger inclined angle which blocks the circulation of the refrigerant gas as shown in FIG. 5. The inclined angle which blocks the circulation of the refrigerant gas is determined by a position at which a slightly larger inclined angle would enable a sufficient amount of refrigerant gas to flow in the external refrigeration circuit 35 and ensure the return of lubricating oil from the circuit 35. Hence, the circulation of the refrigerant gas between the external refrigeration circuit 35 and the compressor is blocked when the amount of refrigerant gas flowing in the circuit 35 is not sufficient to return the lubricating oil into the compressor. This allows the lubricating oil to always be suspended in the refrigerant gas when returning to the compressor during circulation between the external refrigeration circuit 35 and the compressor and eliminates cases in which the gas returns without the oil. Accordingly, a reduction in the amount of oil in the compressor is prevented and thus lubrication is always sufficient. In addition, the minimum inclined angle of the swash plate 15 may be determined at an angle smaller than the angle which secures a flow amount of refrigerant gas sufficient to return the lubricating oil. This reduces in power loss.

When the vehicle of the engine is stopped, operation of the compressor is also stopped. This de-excites the solenoid 33 of the electromagnetic valve 32, opens the suction passage 31, and moves the swash plate 15 toward the minimum inclined angle. Continuation of the compressor in a deactivated state equalizes the pressure within the compressor. In this state, the swash plate 15 is kept at the minimum inclined angle by the first spring 41. Therefore, when the engine is started and operation of the compressor is commenced, rotation of the swash plate 15 is started from the minimum inclined angle, where load torque is the smallest. Accordingly, shock produced during the commencement of the compressor operation is minimal.

In this embodiment, the supply of the refrigerant gas to the suction chamber 3*a* from the external refrigeration circuit 35 is allowed or inhibited by moving the spool 21 in response to the inclination of the swash plate 15. The use of this spool 21 effectively suppresses the torque change when the swash plate 15 is shifted between the maximum inclined angle and the minimum inclined angle. Although the opening and closing of the supply passage 31 are frequently repeated in accordance with a change in the cooling load of the compressor, the change-oriented shock is minimal because drastic changes in torque are suppressed by the action of the spool 21.

The outlet of the suction passage 26 defined along the axis L of the drive shaft 9 is shut by the spool 21 which moves along the axis L. The force which presses the shutter surface 21*c* of the spool 21 against the positioning surface 27 to shut the suction passage 26 is obtained from the urging force in the direction reducing the inclined angle of the swash plate 15. This construction ensures a positive seal between the positioning surface 27 and the shutter surface 21*c* of the spool 21.

Figure 9:
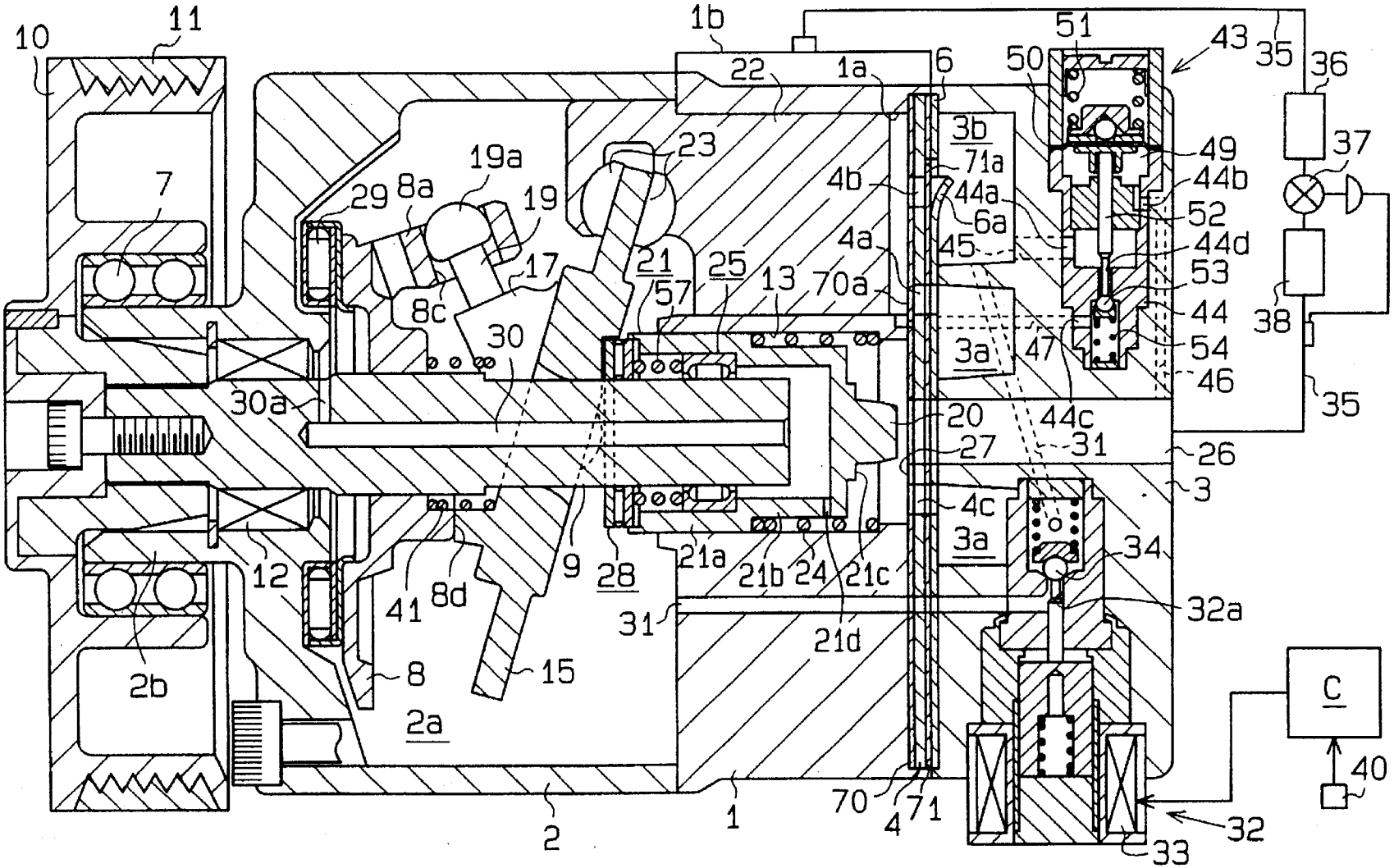
FIG. 9 is a side elevational cross-section view of an overall compressor according to a second embodiment.
Figure 10:
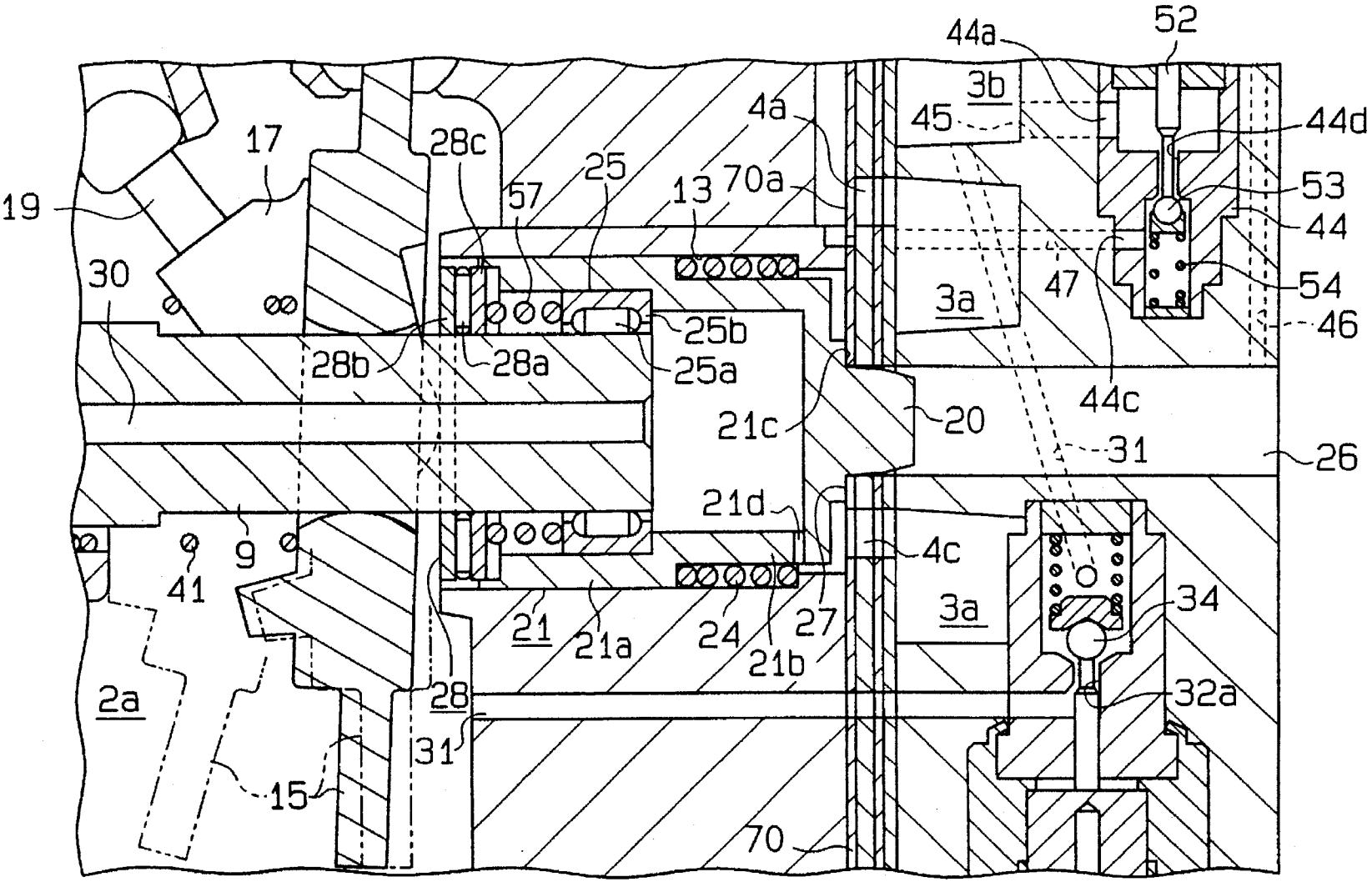
FIG. 10 is an enlarged cross-sectional view of essential parts partially showing the compressor when the swash plate is at an inclined angle preventing circulation of refrigerant gas.

A second embodiment of the present invention will now be described with reference to FIGS. 9 and 10. In this embodiment, the members identical to those in the first embodiment are indicated by the same numerals and not explained.

In the second embodiment, a displacement control valve 43 is attached to the rear housing 3. The pressure in the crank chamber 2*a* is controlled by this control valve 43. A valve housing 44 which constitutes the control valve 43 is provided with a first port 44*a*, a second port 44*b* and a third port 44*c*. The first port 44*a* communicates with the discharge chamber 3*b* via a passage 45. The second port 44*b* communicates with the suction passage 26 via an inlet passage 46. The third port 44*c* communicates with the crank chamber 2*a* via a passage 47.

A suction pressure detection chamber 49 communicates with the second port 44*b*. The pressure in this detection chamber 49 acts against an adjust spring 51 via a diaphragm 50. The spring force of the adjust spring 51 is transmitted to a valve body 53 with the diaphragm 50 and a rod 52. The urging force of a spring 54 acts on the valve body 53 in the direction to close a valve hole 44*d*. In accordance with a change in suction pressure in the detection chamber 49, the valve body 53 opens or closes the valve hole 44*d*.

When the cooling load of the compressor is large and the suction pressure is high with the solenoid 33 being excited to close the supply passage 31, the pressure in the detection chamber 49 increases and the valve body 53 closes the valve hole 44*d*. When the valve hole 44*d* is closed, the first port 44*a* is disconnected from the third port 44*c*, causing the discharge chamber 3*b* to be disconnected from the crank chamber 2*a*. Since the refrigerant gas in the crank chamber 2*a* flows into the suction chamber 3*a* via the passage 30 and the pressure release hole 21*d*, the pressure in the crank chamber 2*a* falls. Since the suction pressure in the cylinder bores 1*a* is high, the difference between the pressure in the crank chamber 2*a* and the pressure in the cylinder bores 1*a* decreases. Accordingly, the inclined angle of the swash plate 15 becomes larger as shown in FIG. 9.

When the cooling load of the compressor is small and the suction pressure is low, the size of the opening of the valve hole 44*d* by the valve body 53 increases and the amount of the refrigerant gas flowing into the crank chamber 2*a* from the discharge chamber 3*b* increases. Consequently, the pressure in the crank chamber 2*a* rises. As the suction pressure in the cylinder bores 1*a* is low, the difference between the pressure in the crank chamber 2*a* and the pressure in the cylinder bores 1*a* increases. Therefore, the inclined angle of the swash plate becomes smaller as shown in FIG. 10.

When the cooling load of the compressor is very small and the suction pressure is very low, the size of the opening of the valve hole 44*d* by the valve body 53 becomes maximum. Consequently, the pressure in the crank chamber 2*a* rises and the swash plate 15 moves toward the minimum angle. When the solenoid 33 is de-excited, the valve body 34 opens the valve hole 32*a*, opening the supply passage 31. Consequently, the pressure in the crank chamber 2*a* rises and the swash plate 15 moves toward the minimum angle.

In other words, in this second embodiment, the inclination of the swash plate 15 is variably controlled continuously between the minimum inclined angle and the maximum inclined angle according to changes in the opening size of the control valve 43 which corresponds to the cooling load. The computer C excites and de-excites the solenoid 33 of the electromagnetic valve 32 based on the ON/OFF action of the activation switch 40.

In this second embodiment, a coil spring 57 is interposed by the thrust bearing 28 and the radial bearing 25. One end of the coil spring 57 abuts against the race 28*c* of the thrust bearing 28 while the other end of the spring 57 abuts against the outer race 25*b* of the radial bearing 25. The coil spring 57 transmits the movement of the swash plate 15 to the spool 21 via the radial bearing 25. The spring force of the coil spring 57 is greater than that of the second spring 24. The coil spring 57 becomes contracted after contraction of the second spring 24 abuts the shutter surface 21*c* against the positioning surface 27. Accordingly, the swash plate 15 can be further inclined from the inclined angle which shuts the circulation of the refrigerant gas, as shown in the solid lines of FIG. 10, to a smaller angle. The two-dotted line on the left side of FIG. 10 shows the swash plate 15 at the maximum inclined angle while the two-dotted line on the right side shows the swash plate 15 at the minimum inclined angle. The minimum inclined angle of the swash plate 15 is restricted by the race 28*c* of the thrust bearing 28 abutting against the end face of the spool 21.

In this embodiment, as in the first embodiment, the lubricating oil is always suspended in the refrigerant gas when returning to the compressor during circulation between the external refrigeration circuit 35 and the compressor. This eliminates cases where the gas returns without the oil. As a result, a reduction of the amount of oil in the compressor is prevented. Thus, lubrication insufficiency does not take place. In addition, the minimum inclined angle of the swash plate 15 may be determined at an angle smaller than the angle which secures a flow amount of refrigerant gas sufficient to return the lubricating oil. This reduces power loss.

Figure 11:
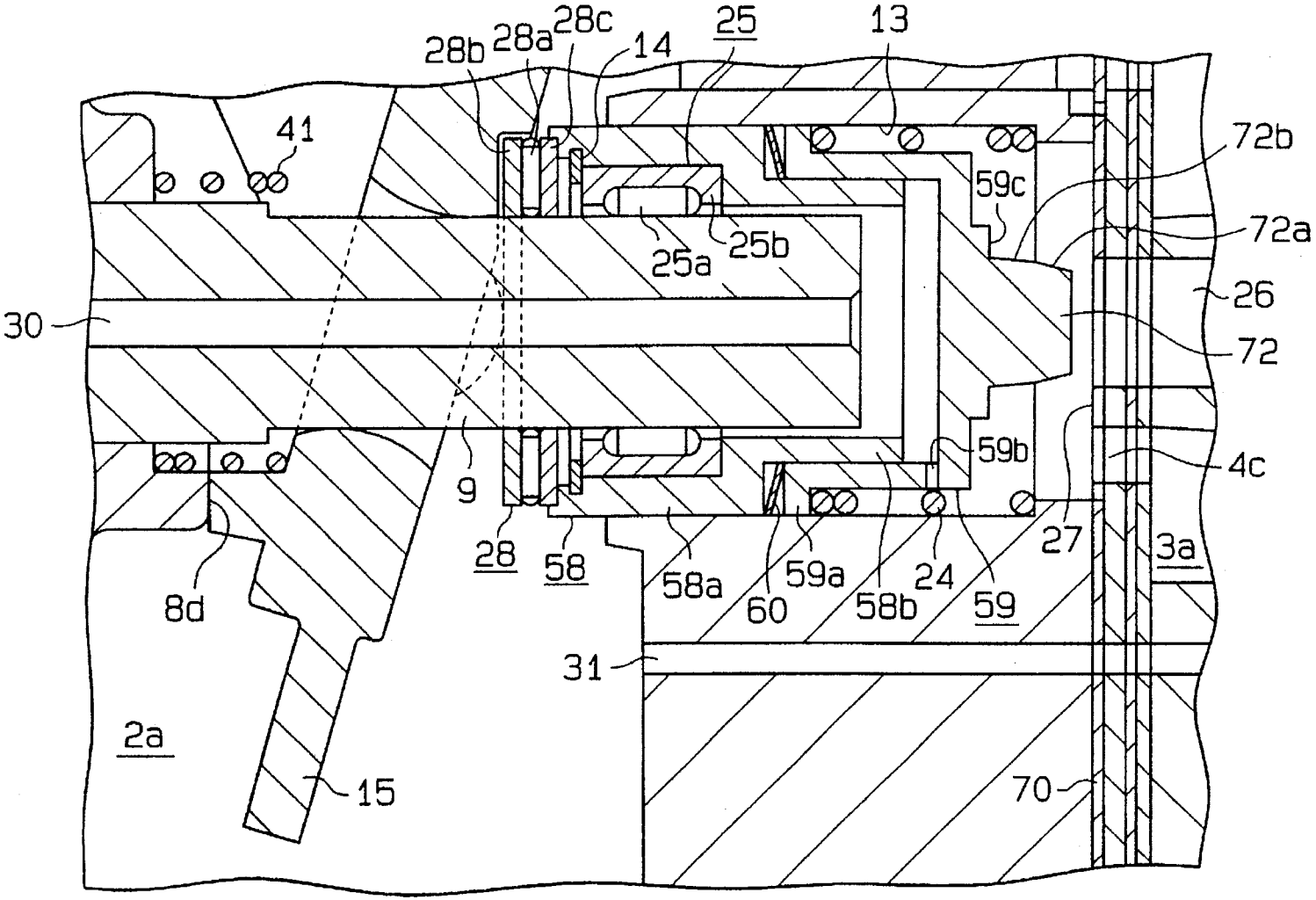
FIG. 11 is an enlarged cross-sectional view of essential parts partially showing the compressor according to a third embodiment.
Figure 12:
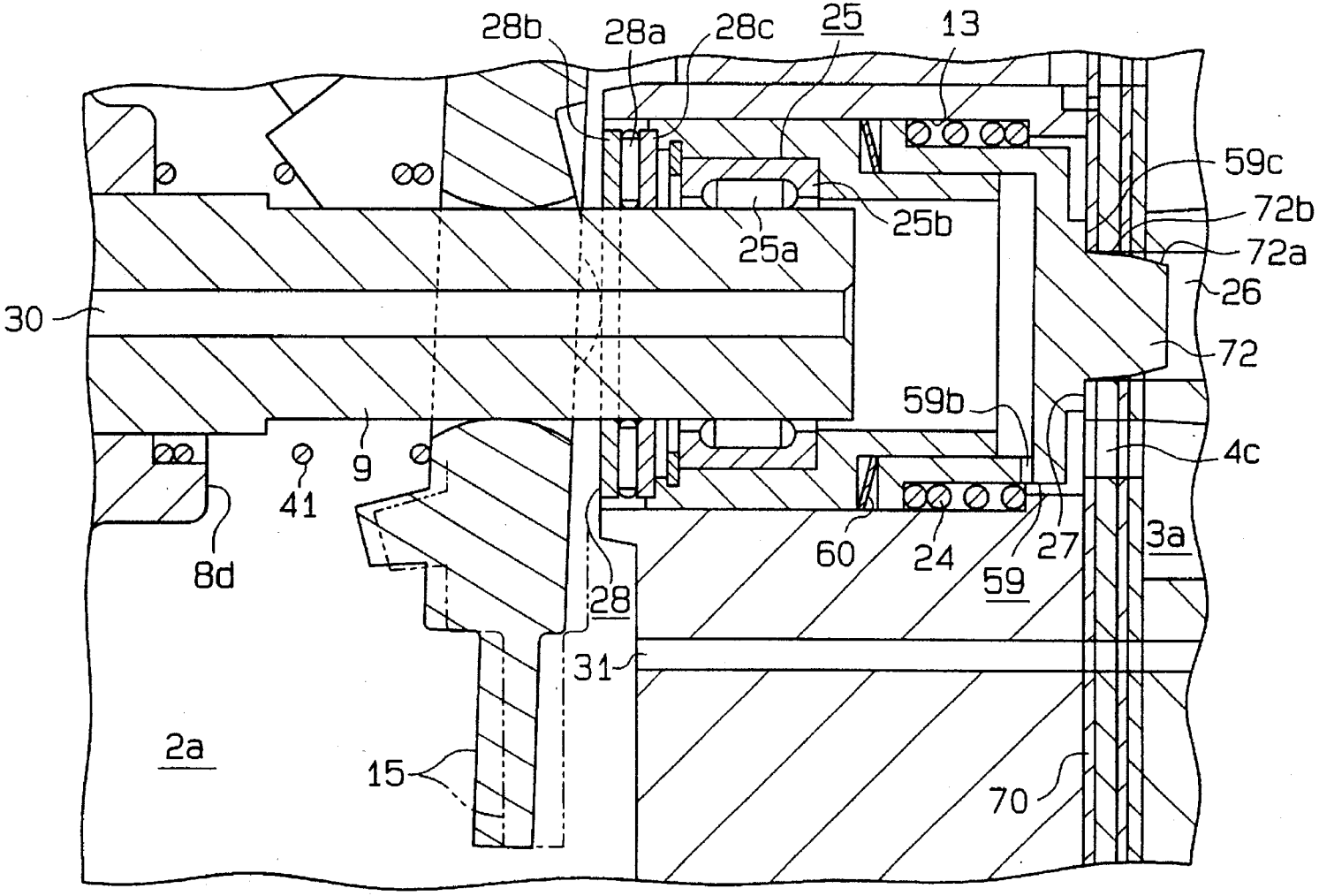
FIG. 12 is an enlarged cross-sectional view of essential parts partially showing the compressor when the swash plate is at an inclined angle blocking circulation of refrigerant gas.

A third embodiment of the present invention will now be described with reference to FIGS. 11 and 12. In this embodiment, the members identical to those in the first embodiment are indicated by the same numerals and not explained.

A support cylinder 58 is slidably retained in the shutter chamber 13. The shutter chamber 13 has a large diameter portion 58*a* and a small diameter portion 58*b*. A spool 59 is slidably supported on the small diameter portion 58*b*. A belleville spring 60 is located between a stepped portion, defined between the large diameter portion 58*a* and the small diameter portion 58*b*, and a flange 59*a* of the spool 59. A pressure release hole 59*b* is formed in the peripheral wall of the spool 59. The second spring 24 is between the flange 59*a* and the inner surface of the shutter chamber 13. The release hole 59*b* communicates the inside of the spool 59 with the shutter chamber 13. Movement of the swash plate 15 is transmitted to the spool 59 via the thrust bearing 28, the supporter cylinder 58, and the belleville spring 60. The suction passage 26 is shut by the abutment between a shutter surface 59*c* of the spool 59 and the positioning surface 27. A restriction 72 is formed integrally with the shutter surface 59*c* of the spool 59. As in the same manner with the restriction 20 of the first embodiment, a tapered first surface 72*a* is provided at the distal end while a tapered second portion 72*b* is provided at the proximal end.

The spring force of the belleville spring 60, being greater than that of the second spring 24, deforms the spring 60 into a flat shape after the second spring 24 is contracted for abutment between the shutter surface 59*c* and the positioning surface 27. Accordingly, the swash plate 15 can be further inclined from the inclined angle which shuts the circulation of the refrigerant gas, as shown in the solid lines of FIG. 12, to a smaller angle while deforming the belleville spring 60 into a flat shape. The two-dotted line of FIG. 12 shows the swash plate 15 at the minimum inclined angle.

In this embodiment, as in the same manner with each of the above embodiments, the lubricating oil is always suspended in the refrigerant gas when returning to the compressor during circulation between the external refrigeration circuit 35 and the compressor. This eliminates cases in which the gas returns without the oil. As a result, a reduction of the amount of oil in the compressor is prevented. Thus, lubrication insufficiency does not take place. In addition, the minimum inclined angle of the swash plate 15 may be determined at an angle smaller than the angle which secures a flow amount of refrigerant gas sufficient enough to return the lubricating oil. This reduces power loss.

Figure 13:
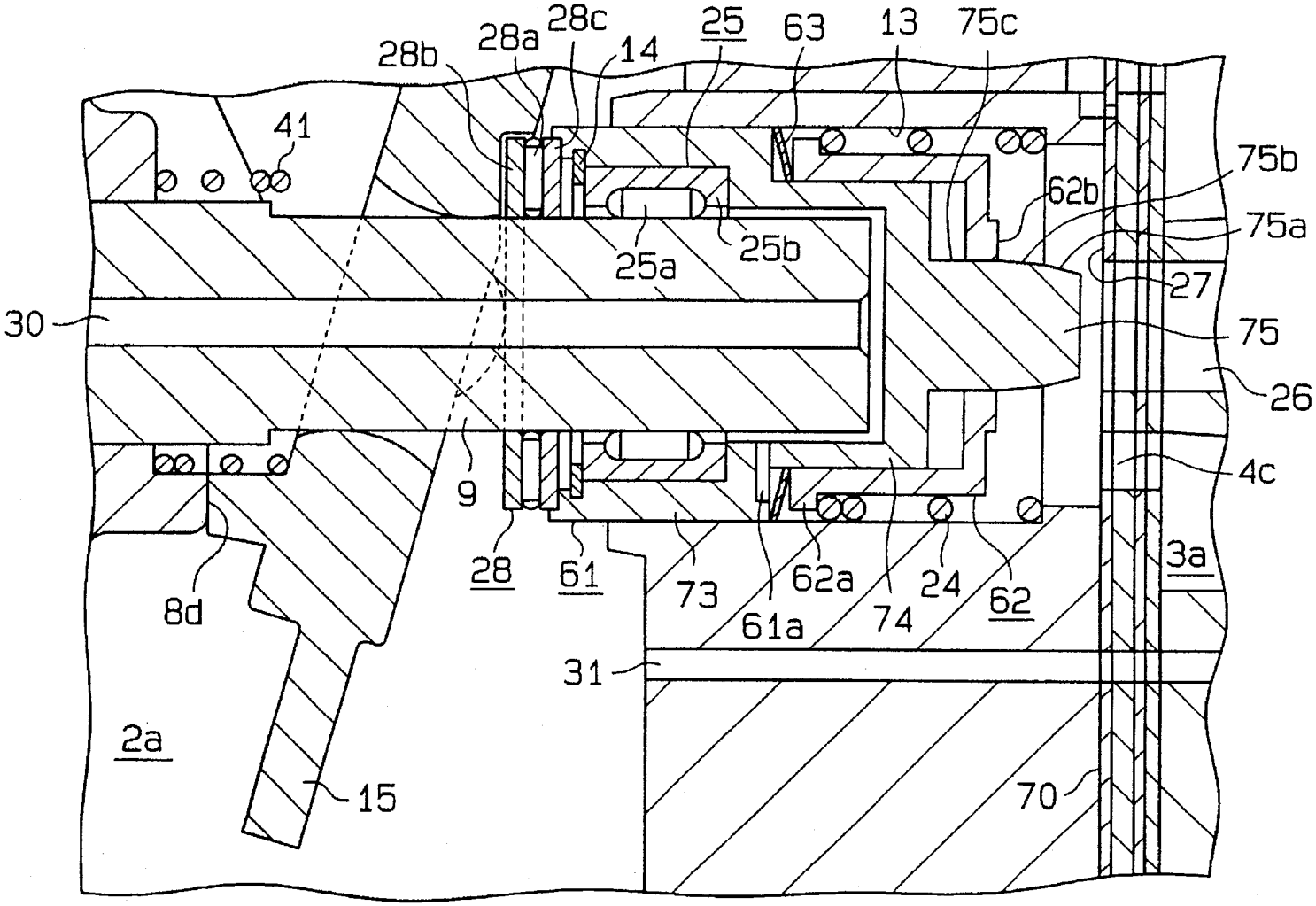
FIG. 13 is an enlarged cross-sectional view of essential parts partially showing the compressor according to a fourth embodiment.
Figure 14:
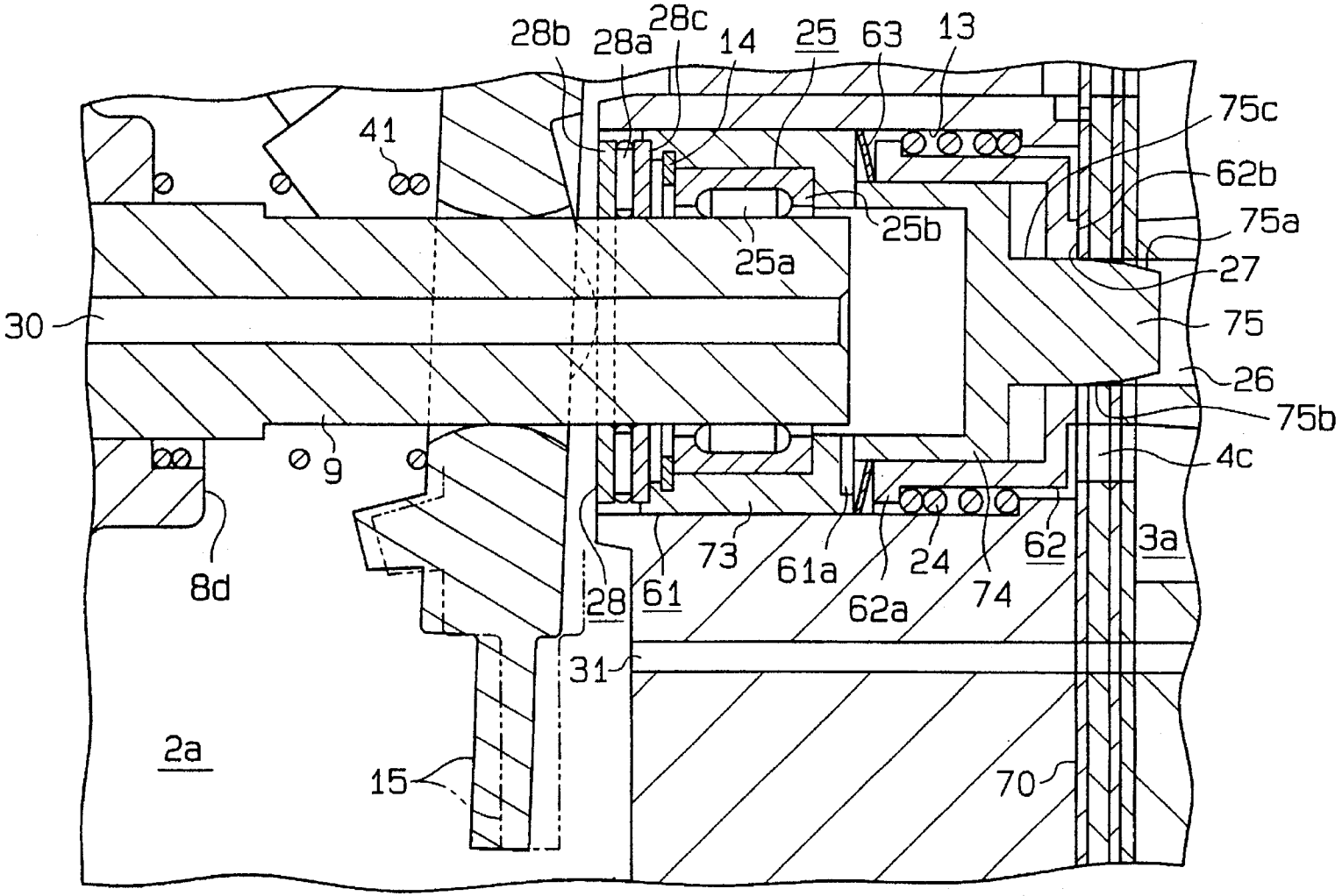
FIG. 14 is an enlarged cross-sectional view of essential parts partially showing the compressor when the swash plate is at an inclined angle blocking circulation of refrigerant gas.

A fourth embodiment of the present invention will now be described with reference to FIGS. 13 and 14. In this embodiment, the members identical to those in the first embodiment are indicated by the same numerals and not explained.

In this embodiment, a cylindrical restriction 61 is slidably accommodated in the shutter chamber 13. The restriction 61 has a large diameter portion 73, a small diameter portion 74, and a restricting projection 75. As with the restriction 20 of the first embodiment, a tapered first and second surface 75*a*, 75*b* is provided at its distal end. A cylindrical third surface 75*c* is provided at the proximal end. A spool 62 is slidably supported by the small diameter portion 74 and the third surface 75*c*. A belleville spring 63 is located between a stepped portion, which is between the small and large diameter portions 73, 74, and a flange 62*a* of the spool 62. The second spring 24 is between the flange 62*a* and the inner surface of the shutter chamber 13. A pressure release hole 61*a* is formed in the stepped portion between the large and small diameter portions 73, 74. The release hole 61*a* communicates the inside of the restriction 61 with the shutter chamber 13. The movement of the swash plate 15 is transmitted to the spool 62 via the thrust bearing 28, the restriction 61, and the belleville spring 63. The suction passage 26 is shut by the abutment of a shutter surface 62*b* of the spool 62 with the positioning surface 27.

The spring force of the belleville spring 63, being greater than that of the second spring 24, deforms the spring 63 into a flat shape after the second spring 24 is contracted for abutment between the shutter surface 62*b* and the positioning surface 27. Accordingly, the swash plate 15 can be further inclined from the inclined angle which shuts the circulation of the refrigerant gas as shown in the solid lines of FIG. 14 to a smaller angle while deforming the belleville spring 63 into a flat shape. The two-dotted line of FIG. 14 shows the swash plate 15 at the minimum inclined angle.

In this embodiment, as in each of the above embodiments, the lubricating oil is always suspended in the refrigerant gas when returning to the compressor during circulation between the external refrigeration circuit 35 and the compressor. This eliminates cases in which the gas returns without the oil. As a result, a reduction of the amount of oil in the compressor is prevented. Thus, lubrication insufficiency does not take place. In addition, the minimum inclined angle of the swash plate 15 may be determined at an angle smaller than the angle which results in a flow amount of refrigerant gas sufficient to return the lubricating oil. This reduces power loss.

Figure 15:
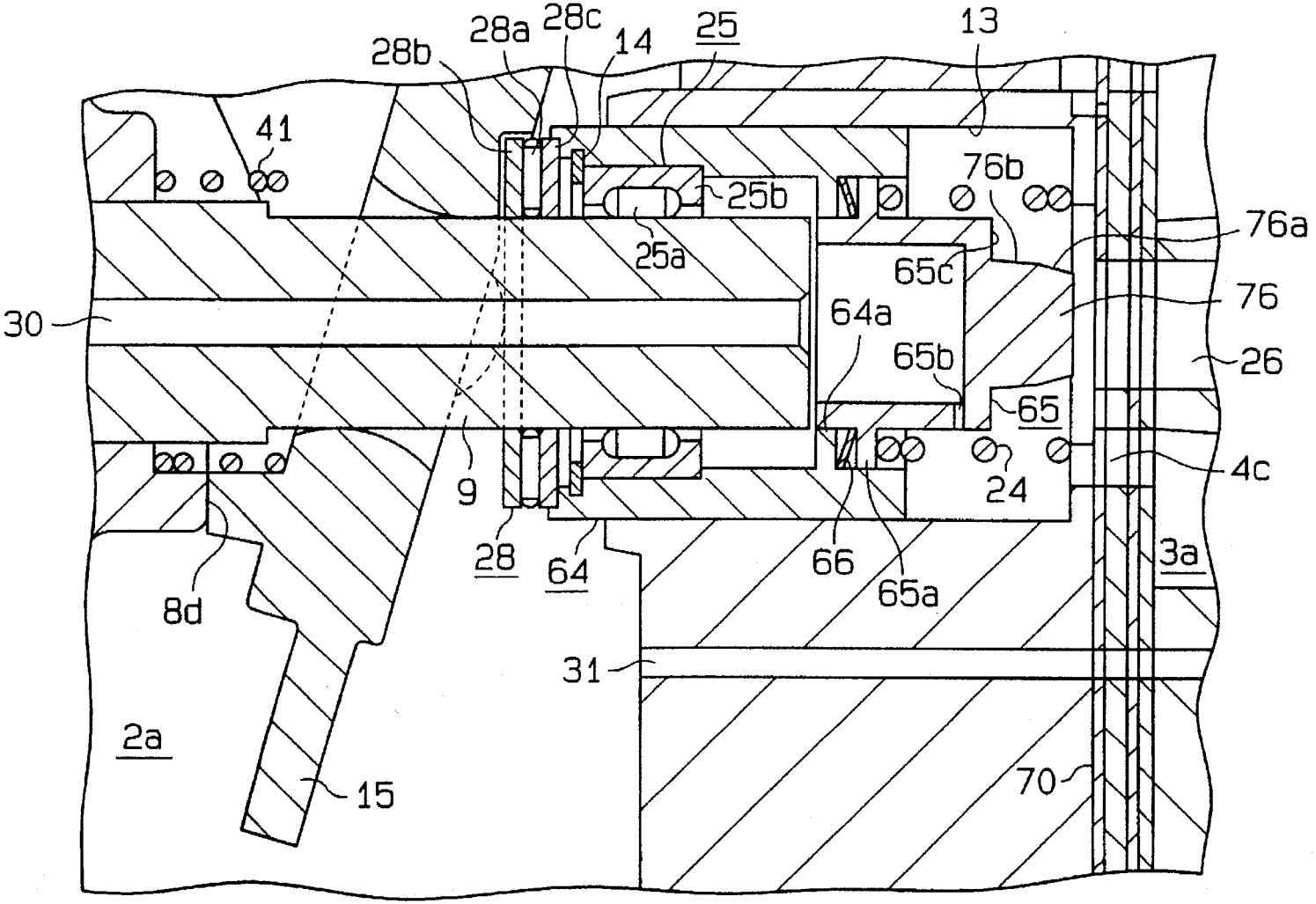
FIG. 15 is an enlarged cross-sectional view of essential parts partially showing the compressor according to a fifth embodiment.
Figure 16:
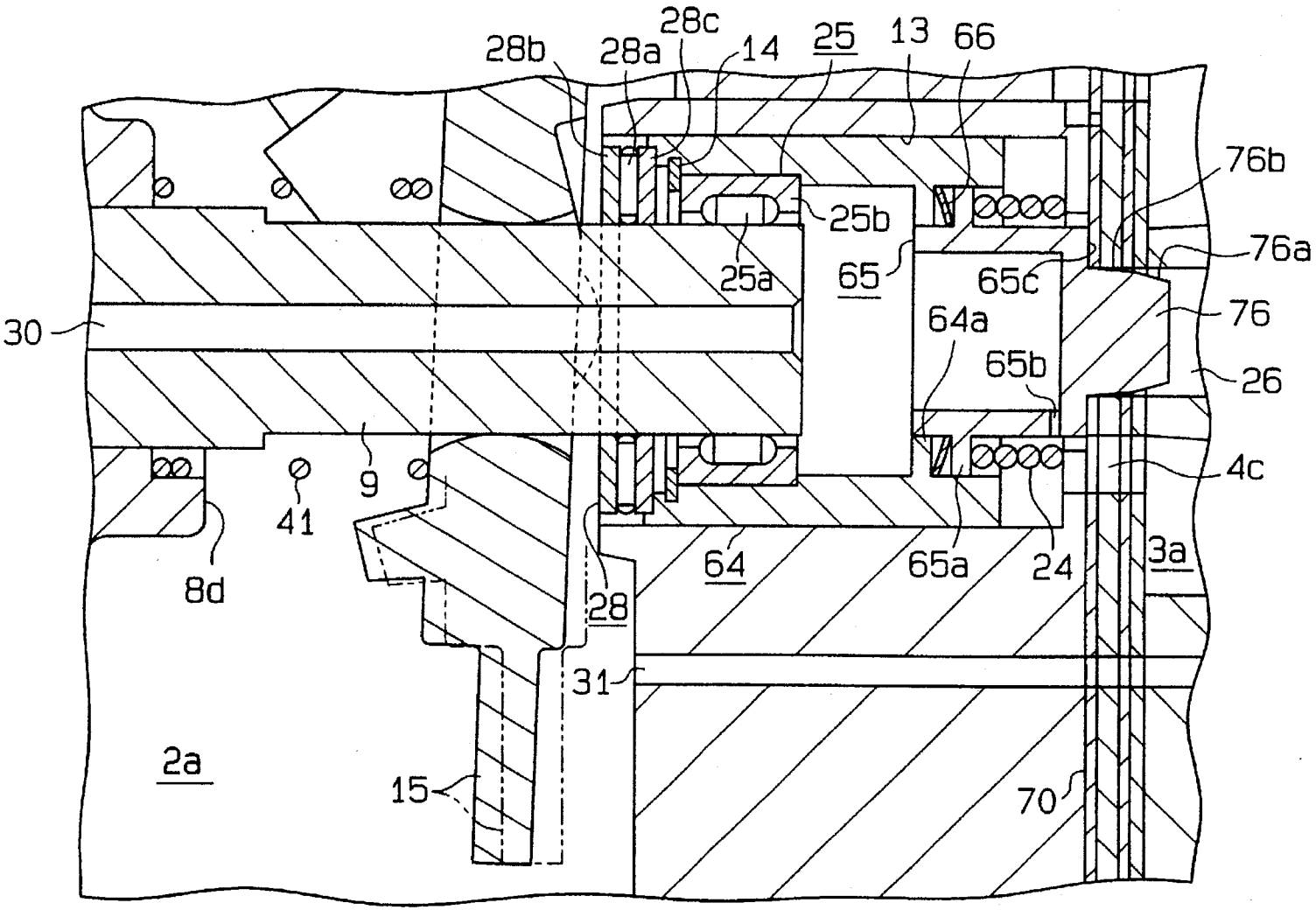
FIG. 16 is an enlarged cross-sectional view of essential parts partially showing the compressor when the swash plate is at an inclined angle blocking circulation of refrigerant gas.

A fifth embodiment of the present invention will now be described with reference to FIGS. 15 and 16. In this embodiment, the members identical to those in the first embodiment are indicated by the same numerals and not explained.

In this embodiment, a support cylinder 64 is slidably accommodated in the shutter chamber 13. A flange 64*a* is formed on the inner surface of the support cylinder 64. A flange 65*a* is formed on the outer surface of the spool 65. A belleville spring 66 is disposed between the two flanges 64*a*, 65*a*. The second spring 24 is disposed between the flange 65*a* and the inner surface of the shutter chamber 13. A pressure release hole 65*b* communicates the inside of the spool 65 with the shutter chamber 13. The movement of the swash plate 15 is transmitted to the spool 65 via the thrust bearing 28, the support cylinder 64, and the belleville spring 66. The suction passage 26 is shut by the abutment of the shutter surface 65*c* of the spool 65 with the positioning surface 27. A restriction 76 is formed integrally with the shutter surface 65*c* of the spool 65. As with the restriction 20 of the first embodiment, a tapered first surface 76*a* is provided at the distal end while a tapered second portion 76*b* is provided at the proximal end.

The spring force of the belleville spring 66, being greater than that of the second spring 24, deforms the spring 66 into a flat shape after the second spring 24 is contracted for abutment between the shutter surface 65*c* and the positioning surface 27. Accordingly, the swash plate 15 can be further inclined from the inclined angle which inhibits the circulation of the refrigerant gas as shown in the solid lines of FIG. 16 to a smaller angle while deforming the belleville spring 63 into a flat shape. The two-dotted line of FIG. 16 shows the swash plate 15 at the minimum inclined angle.

In this embodiment, as in the same manner with each of the above embodiments, the lubricating oil is always suspended in the refrigerant gas when returning to the compressor during circulation between the external refrigeration circuit 35 and the compressor. This eliminates cases in which the gas returns without the oil. As a result, a reduction of the amount of oil in the compressor is prevented. Thus, lubrication insufficiency does not take place. In addition, the minimum inclined angle of the swash plate 15 may be determined at an angle smaller than the angle which enables a flow amount of refrigerant gas sufficient to return the lubricating oil. This reduces power loss.

Although only five embodiments of the present invention have been described herein, it should be apparent to those skilled in the art that the present invention may be embodied in many other specific forms without departing from the spirit or scope of the invention.

Particularly, it should be understood that the present invention may be embodied in the forms described below.

(1) In each of the above embodiments, a rubber material may be used as a means for transmitting the movement of the swash plate 15 to the spool instead of the belleville spring.

(2) In each of the above embodiments, the passage which is used to discharge refrigerant gas from the compressor may be closed to stop the circulation of refrigerant gas between the external refrigeration circuit 35 and the compressor.

(3) In each of the above embodiments, an electromagnetic valve may be provided in the external refrigerating circuit 35. In addition, a sensor for detecting the inclined angle of the swash plate 15 may be provided. In this construction, when the inclination of the swash plate 15 is between the inclined angle which inhibits the circulation of gas and the minimum inclined angle, the electromagnetic valve is closed by a detecting signal sent from the sensor to inhibit the circulation of gas.

(4) In the second embodiment, the electromagnetic valve 32 and the displacement control valve 43 may be formed integrally.

Therefore, the present examples and embodiments are to be considered as illustrative and not restrictive and the invention is not to be limited to the details given herein, but may be modified within the scope of the appended claims.

What is claimed is:

1. A compressor having a swash plate located in a crank chamber and mounted on a drive shaft for integral rotation with the drive shaft, a piston coupled to the swash plate and located in a cylinder bore and an internal gas passage including the crank chamber, a suction chamber and a discharge chamber, said internal gas passage being connected to an external circuit separately provided from the compressor, wherein the rotation of the drive shaft is converted to a reciprocating movement of the piston to vary a capacity of the cylinder bore, said piston compressing a gas supplied from the external circuit to the internal gas passage and discharging the gas to the external circuit, said compressor comprising:

wherein said swash plate is tiltable between a maximum inclining angle and a minimum inclining angle with respect to a plane perpendicular to an axis of the drive shaft according to a difference between pressures in the crank chamber and the suction chamber, and wherein said swash plate controls a displacement of the compressor to be maximum and minimum when the swash plate is at the maximum inclining angle and at the minimum inclining angle, respectively; and means for inhibiting the circulation of the gas through the internal gas passage and the external circuit when the swash plate is located between the minimum inclining angle and a first inclining angle, said first inclining angle being greater than the minimum inclining angle of the swash plate.

2. The compressor according to claim 1 further comprising:

a lubricant oil, mixed with the gas, for lubricating components of the compressor by flowing within the internal gas passage, wherein said lubricant oil and the gas circulate within the internal gas passage when the circulation of the gas through the internal gas passage and the external circuit is inhibited, and said lubricant oil and the gas circulate through the internal gas passage and the external circuit when the gas is allowed to circulate through the internal gas passage and the external circuit; and wherein said first inclining angle is set at an inclining angle for enabling the flow rate of the gas to be great enough to return the lubricant oil contained in the gas to the internal gas passage when the gas circulates through the internal gas passage and the external circuit.

3. The compressor according to claim 2, wherein said inhibiting means includes means for disconnecting the internal gas passage from the external circuit.

4. The compressor according to claim 3, wherein said disconnecting means includes:

a shutter member movable between a first position where the shutter member allows for connection of the internal gas passage and the external circuit and a second position where the shutter member blocks the connection of the internal gas passage and the external circuit; and means for transferring movement of the swash plate to the shutter member, wherein said transferring means moves the shutter member to the second position when the swash plate is at the first inclining angle and allows the swash plate to be moved between the first inclining angle and the minimum inclining angle while the shutter member is kept at the second position.

5. The compressor according to claim 4, wherein said transferring means includes a elastic member disposed between the swash plate and the shutter member, said elastic member being resiliently deformed in response to the movement of the swash plate between the first inclining angle and the minimum inclining angle while the shutter member is kept at the second position.

6. The compressor according to claim 5, wherein said elastic member includes a spring.

7. The compressor according to claim 6, wherein said spring is a belleville spring.

8. The compressor according to claim 7 further comprising:

means for regulating the shutter member at the second position when the shutter member moves toward the second position; and wherein said swash plate is regulated at the minimum inclining angle when the shutter member is regulated at the second position and the belleville spring deforms into a flat shape.

9. The compressor according to claim 4, wherein said transferring means includes a thrust bearing located between the swash plate and the shutter member to inhibit the rotation of the swash plate from being transferred to the shutter member.

10. The compressor according to claim 4 further comprising a suction passage for connecting the external circuit and the internal gas passage, wherein said shutter member selectively opens and closes the suction passage.

11. The compressor according to claim 10, wherein said shutter member moves along the axis of the drive shaft, and wherein said suction passage extends along the axis of the drive shaft.

12. The compressor according to claim 4, wherein said internal gas passage includes:

said suction chamber for receiving the gas from the external circuit and supplying the gas to the cylinder bore;

said discharge chamber for receiving the compressed gas from the cylinder bore and supplying the compressed gas to the external circuit;

a first passage for connecting the crank chamber and the suction chamber to deliver the gas from the crank chamber to the suction chamber;

a second passage for connecting the discharge chamber and the crank chamber to deliver the gas from the discharge chamber to the crank chamber; and a circulating passage including the first passage and the second passage, said circulating passage being defined upon disconnection of the internal gas passage from the external circuit.

13. The compressor according to claim 12 further comprising a valve for selectively opening and closing the second passage in response to operational conditions of the compressor.

14. The compressor according to claim 13, wherein said valve includes an electromagnetic valve.

15. The compressor according to claim 14 further comprising a computer for controlling the electromagnetic valve in response to signals indicative of the operational conditions of the compressor.

16. The compressor according to claim 13 further comprising a displacement control valve for adjusting the difference between the pressure in the crank chamber and the pressure in the suction chamber in response to the cooling load of the compressor to control the inclined angle of a swash plate.

17. A compressor having a swash plate located in a crank chamber and mounted on a drive shaft for integral rotation with the drive shaft, a piston coupled to the swash plate and located in a cylinder bore and an internal gas passage including the crank chamber, a suction chamber and a discharge chamber, said internal gas passage selectively being connected to and being disconnected from an external circuit separately provided from the compressor, wherein the rotation of the drive shaft is converted to a reciprocating movement of the piston to vary a capacity of the cylinder bore, said piston compressing a gas supplied from the external circuit to the internal gas passage and discharging the gas to the external circuit, said compressor comprising:

wherein said swash plate is tiltable between a maximum inclining angle and a minimum inclining angle with respect to a plane perpendicular to an axis of the drive shaft according to a difference between pressures in the crank chamber and the suction chamber, and wherein said swash plate controls a displacement of the compressor to be maximum and minimum when the swash plate is at the maximum inclining angle and at the minimum inclining angle, respectively;

a suction passage for connecting the external circuit and the internal gas passage;

a shutter member movable between a first position where the shutter member opens the suction passage and a second position where the shutter member closes the suction passage; and means for transferring movement of the swash plate to the shutter member, wherein said transferring means moves the shutter member to the second position when the swash plate is at a first inclining angle and allows the swash plate to be moved between the first inclining angle and the minimum inclining angle while the shutter member is kept at the second position, said first inclining angle being greater than the minimum inclining angle of the swash plate.

18. The compressor according to claim 17 further comprising:

a lubricant oil, mixed with the gas, for lubricating components of the compressor by flowing within the internal gas passage, wherein said lubricant oil and the gas circulate within the internal gas passage when the suction passage is closed, and said lubricant oil and the gas circulate through the internal gas passage and the external circuit when the suction passage is opened; and wherein said first inclining angle is set at an inclining angle for enabling the flow rate of the gas to be great enough to return the lubricant oil contained in the gas to the internal gas passage when the gas circulates through the internal gas passage and the external circuit.

19. The compressor according to claim 18, wherein said shutter member moves along the axis of the drive shaft, and wherein said suction passage extends along the axis of the drive shaft.

20. The compressor according to claim 19, wherein said transferring means includes a belleville spring disposed between the swash plate and the shutter member, said belleville spring being resiliently deformed in response to the movement of the swash plate between the first inclining angle and the minimum inclining angle while the shutter member is kept at the second position.

21. The compressor according to claim 20 further comprising:

means for regulating the shutter member at the second position when the shutter member moves toward the second position; and wherein said swash plate is regulated at the minimum inclining angle when the shutter member is regulated at the second position and the belleville spring deforms into a flat shape.

22. The compressor according to claim 21, wherein said transferring means includes a thrust bearing located between the swash plate and the shutter member to inhibit the rotation of the swash plate from being transferred to the shutter member.

23. The compressor according to claim 22, wherein said internal gas passage includes:

said suction chamber for receiving the gas from the external circuit and supplying the gas to the cylinder bore;

said discharge chamber for receiving the compressed gas from the cylinder bore and supplying the compressed gas to the external circuit;

a first passage for connecting the crank chamber and the suction chamber to deliver the gas from the crank chamber to the suction chamber;

a second passage for connecting the discharge chamber and the crank chamber to deliver the gas from the discharge chamber to the crank chamber; and a circulating passage including the first passage and the second passage, said circulating passage being defined upon closing the suction passage.

24. The compressor according to claim 23 further comprising:

an electromagnetic valve for selectively opening and closing the second passage; and a computer for controlling the electromagnetic valve in response to signals indicative of operational conditions of the compressor.

25. The compressor according to claim 24 further comprising a displacement control valve for adjusting the difference between the pressure in the crank chamber and the pressure in the suction chamber in response to the cooling load of the compressor to control the inclined angle of a swash plate.

26. A compressor having a swash plate located in a crank chamber and mounted on a drive shaft for integral rotation with the drive shaft, a piston coupled to the swash plate and located in a cylinder bore and an internal gas passage including the crank chamber, a suction chamber and a discharge chamber, said internal gas passage selectively being connected to and being disconnected from an external circuit separately provided from the compressor, wherein the rotation of the drive shaft is converted to a reciprocating movement of the piston to vary a capacity of the cylinder bore, said piston compressing a gas supplied from the external circuit to the internal gas passage and discharging the gas to the external circuit, said compressor comprising:

wherein said swash plate is tiltable between a maximum inclining angle and a minimum inclining angle with respect to a plane perpendicular to an axis of the drive shaft according to a difference between pressures in the crank chamber and the suction chamber, and wherein said swash plate controls a displacement of the compressor to be maximum and minimum when the swash plate is at the maximum inclining angle and at the minimum inclining angle, respectively;

a suction passage for connecting the external circuit and the internal gas passage;

a shutter member movable between a first position where the shutter member opens the suction passage and a second position where the shutter member closes the suction passage;

means for transferring movement of the swash plate to the shutter member, wherein said transferring means moves the shutter member to the second position when the swash plate is at a first inclining angle and allows the swash plate to be moved between the first inclining angle and the minimum inclining angle while the shutter member is kept at the second position, said first inclining angle being greater than the minimum inclining angle of the swash plate;

a lubricant oil, mixed with the gas, for lubricating components of the compressor by flowing within the internal gas passage, wherein said lubricant oil and the gas circulate within the internal gas passage when the suction passage is closed, and said lubricant oil and the gas circulate through the internal gas passage and the external circuit when the suction passage is opened;

said first inclining angle being set at an inclining angle for enabling the flow rate of the gas to be great enough to return the lubricant oil contained in the gas to the internal gas passage when the gas circulates through the internal gas passage and the external circuit;

said transferring means including:

a belleville spring disposed between the swash plate and the shutter member, said belleville spring being resiliently deformed in response to the movement of the swash plate between the first inclining angle and the minimum inclining angle while the shutter member is kept at the second position; and a thrust bearing located between the swash plate and the shutter member to inhibit the rotation of the swash plate from being transferred to the shutter member;

said internal gas passage including:

said suction chamber for receiving the gas from the external circuit and supplying the gas to the cylinder bore;

said discharge chamber for receiving the compressed gas from the cylinder bore and supplying the compressed gas to the external circuit;

a first passage for connecting the crank chamber and the suction chamber to deliver the gas from the crank chamber to the suction chamber;

a second passage for connecting the discharge chamber and the crank chamber to deliver the gas from the discharge chamber to the crank chamber; and a circulating passage including the first passage and the second passage, said circulating passage being defined upon closing the suction passage; and an electromagnetic valve for selectively opening and closing the second passage in response to operational conditions of the compressor.

27. The compressor according to claim 26 further comprising a displacement control valve for adjusting the amount of the gas delivering from the discharge chamber to the crank chamber in response to the pressure of the gas supplying from the external circuit to the internal gas passage to control the inclined angle of a swash plate, said control valve operating in response to the pressure generated upstream of the shutter member.

* * * * *